US012397966B2

(12) United States Patent
Ostenrieder

(10) Patent No.: US 12,397,966 B2
(45) Date of Patent: Aug. 26, 2025

(54) STRUCTURAL COMPONENT OF A MODULAR SYSTEM AND ASSEMBLY UNIT FOR USE IN STORAGE OR TRANSPORTATION SYSTEMS

(71) Applicants: Jörg Ostenrieder, Ebenhausen (DE); Katharina Poschinger, Ebenhausen (DE)

(72) Inventor: Jörg Ostenrieder, Ebenhausen (DE)

(73) Assignee: DIE:HAPTIKER GMBH, Taufkirchen (DE)

( * ) Notice: Subject to any disclaimer, the term of this patent is extended or adjusted under 35 U.S.C. 154(b) by 144 days.

(21) Appl. No.: 18/107,395

(22) Filed: Feb. 8, 2023

(65) Prior Publication Data

US 2024/0262568 A1 Aug. 8, 2024

(30) Foreign Application Priority Data

Feb. 8, 2022 (DE) ..... 10 2022 102 923.9

(51) Int. Cl.
*B65D 21/08* (2006.01)
*B65D 21/02* (2006.01)

(52) U.S. Cl.
CPC ..... *B65D 21/086* (2013.01); *B65D 21/0224* (2013.01); *B65D 21/083* (2013.01)

(58) Field of Classification Search
CPC ..... B65D 21/086; B65D 21/0224; B65D 21/083; B65D 7/24; B65D 15/24;
(Continued)

(56) References Cited

U.S. PATENT DOCUMENTS 1,198,524 A * 9/1916 Cunliffe ..... B65D 7/26 220/6
2,057,942 A * 10/1936 Fay ..... A63H 33/108 446/112

(Continued)

FOREIGN PATENT DOCUMENTS

AU 2011100137 A4 3/2011
CN 85104264 A 5/1986

(Continued)

*Primary Examiner* — Andrew D Perreault
(74) *Attorney, Agent, or Firm* — Greenberg Traurig, LLP; Roman Fayerberg; Richard Brooks

(57) ABSTRACT

A structural component is provided for use in storage systems, bundling systems, transportation systems, or structural installations. The structural component is plate-shaped or shell-shaped and includes at least three sides, where at least two sides are provided with a coupling unit for structurally connecting the structural component to a further component. The coupling unit includes at least one first locking element and at least one correspondingly designed second locking element. For connecting the structural component to the further component, the first and the second locking element are displaceable relative to one another from a release position into a first locking position upon moving the first locking element or the second locking element in a first locking direction and are displaceable relative to one another from the release position into a second locking position upon moving the first locking element or the second locking element in a second locking direction.

17 Claims, 35 Drawing Sheets

(58) Field of Classification Search
CPC ..... B65D 21/0204; B65D 11/1846; A63H 33/086; A63H 33/107
USPC ..... 206/4.33, 1.5; 220/4.33
See application file for complete search history.

(56) References Cited

U.S. PATENT DOCUMENTS

| | | | | |
|---|---|---|---|---|
| 3,692,201 | A * | 9/1972 | Garduna | B65D 9/34 217/65 |
| 2006/0237455 | A1 * | 10/2006 | Vargas | B65D 11/1873 220/4.34 |
| 2021/0188480 | A1 | 6/2021 | Pruvost | |

FOREIGN PATENT DOCUMENTS

| | | | |
|---|---|---|---|
| EP | 2181623 | A1 | 5/2010 |
| FR | 3080633 | A3 | 11/2019 |
| WO | 2005/021391 | A1 | 3/2005 |
| WO | 2014/185246 | A1 | 11/2014 |
| WO | 2015/141439 | A1 | 9/2015 |
| WO | 2018227188 | A1 | 12/2018 |
| WO | 2019/204835 | A1 | 10/2019 |

* cited by examiner

STRUCTURAL COMPONENT OF A MODULAR SYSTEM AND ASSEMBLY UNIT FOR USE IN STORAGE OR TRANSPORTATION SYSTEMS

RELATED APPLICATIONS

This application claims priority under 35 U.S.C. § 119 to German Patent Application No. DE 10 2022 102 923.9 filed Feb. 8, 2022, the contents of which are incorporated by reference in its entirety.

TECHNICAL FIELD

The present disclosure relates to a structural component and an assembly unit comprising at least two such structural components which are used for storage or transportation of goods or which are used in structural installations.

Technological Background

For reducing costs and saving resources, reusable receiving means for goods, such as crates, containers, pallets, etc., are increasingly being used in logistics systems. In this context, an efficient use of space is a key requirement to avoid empty space and accordingly unused capacities as well as unnecessary costs during transportation. In order to meet this requirement, efforts are being made to adapt the shape of receiving means to goods, and vice versa. By doing so, an efficient use of space may be achieved, but only for specific goods which may limit reusability and flexibility of the receiving means. It is further known to adapt the goods to be transported to the design of standardized receiving means which, however, may lead to a limited design freedom of goods.

A further aspect in the design of receiving means refers to their storage and transportation in an empty state, i.e. in a state in which no goods are received therein. To enable an efficient use of space also in the empty state, the use of stackable receiving means is known, in particular of receiving means which can be stacked one inside the other. For example, this may be achieved by providing the receiving means with a tapered design, in particular which narrows toward a bottom.

Another approach of improving use of space in the empty state is directed to the use of foldable or demountable receiving means. However, assembly or disassembly of such receiving means may be time and resource consuming. Further, a foldable or demountable design may affect mechanical stability of the receiving means which, in turn, may affect lifetime and reusability of such receiving means.

SUMMARY

Thus, it is an objective of the present disclosure to provide an improved structural component which can flexibly and easily be employed in assembly units for use in storage systems, transportation systems or structural installations. It is a further objective of the present disclosure to provide an assembly unit comprising at least two such structural components.

These objectives are solved by the subject matter of the independent claims. Some embodiments are set forth in the present specification, the Figures as well as the dependent claims.

Accordingly, a structural component, in particular of a modular system, is provided for use in storage systems or bundling systems or transportation systems or structural installations. The structural component is plate-shaped or shell-shaped and comprises at least three sides, wherein at least two sides are provided with a coupling unit for structurally connecting the structural component to a further component, and wherein the coupling unit comprises at least one first locking element and at least one correspondingly designed second locking element. For connecting, in particular for positively, i.e. form-fittingly, and/or non-positively, i.e. force-fittingly, connecting, the structural component to the further component, the first and the second locking element are displaceable relative to one another from a release position into a first locking position upon moving the first locking element and/or the second locking element in a first locking direction and are displaceable relative to one another from the release position into a second locking position upon moving the first locking element and/or the second locking element in a second locking direction.

In other words, the structural component is designed such that, starting from a state in which the first locking element and the second locking element are arranged in the release position, the first locking element and the second locking element are displaceable relative to one another either into the first locking position or into the second locking position. Upon displacing the first locking element or the second locking element into the first or second locking position, a structural connection, in particular a form-fitting or positive connection, to the further component may be established. It has been found that, by providing two locking positions, each of which can be attained starting from the same release position of the locking elements, a particularly flexible use and a high configurability of the structural component may be enabled. For example, by this structural arrangement, it may be enabled that the structural component is structurally connectable to the further component in different relative orientations, thereby enabling a high degree of configurability as well as an easy and effort-reduced assembly.

In the context of the present disclosure, the term "structural component" refers to a component or structural element which is intended for receiving and transmitting forces and/or torques and in particular is made of a rigid material. The structural component may be intended to provide rigidity and/or mechanical stability and/or support and/or mechanical resistance to any object or assembly comprising the structural component. Further, the structural component may be intended to improve technical properties of an assembly comprising the structural component, such as physical and/or chemical properties. For example, the structural component may be intended to provide thermal insulation and/or chemical resistance.

In the present disclosure, the term "assembly" or "assembly unit" refers to an object which comprises or is built up from two or more components and which can be demountable in a non-destructive manner. The term "single piece", in the context of the present disclosure, refers to a component which is not demountable in a non-destructive manner. As such, the structural component may constitute or be an assembly or a single piece.

In some embodiments, the structural component constitutes a component or part of a modular system. Generally, the term "modular system" refers to a system constituted by a limited amount of interconnectable and interchangeable components with predefined and in particular standardized interfaces by means of which a large number of different assemblies or objects can be built. The structural component may be designed correspondingly to other components of the modular system, in particular in view of its shape and structural configuration. Specifically, the coupling units of the structural component may constitute predefined or standardized mechanical interfaces which allow to structurally couple the structural component to the other components having a correspondingly designed mechanical interface.

Specifically, the proposed structural component may be intended for use in storage systems or bundling systems or transportation systems or structural installations. In other words, an assembly unit or object formed by means of the structural component may be employed in storage systems or bundling systems or transportation systems or structural installations. By means of the structural component, a receiving means for goods, in particular a bin, a container, a plate, etc., may be formed. Such a receiving means may be intended for transporting and/or bundling and/or storing goods. Alternatively or additionally, the structural component may be used to build or create an object of a structural installation, such as an item of furniture, a panel, a cladding element, etc. For example, the structural component may be intended to create or form a closed bin or container having a hinged lid for releasing or closing and opening. Such a closed bin or container may comprise or consist of four or six structurally identical structural components. In this application, each one of the structural components may serve as a hinged lid. However, the proposed structural component is not limited to this specific application, but rather may be employed in any other suitable application.

The structural component can be plate-shaped or shell-shaped. In the context of the present disclosure, the term "plate-shaped component" refers to a component extending along a plane. In other words, a plate-shaped component typically has an extension in a width direction and a length direction that is greater compared to an extension along a thickness direction of the component. Accordingly, the structural component may be provided in the form of a planar plate. For example, the structural component may be provided in the form of a substantially cuboid plate or a substantially prism-shaped plate. The term "shell-shaped element" in the sense of the present disclosure refers to a curved component, i.e. having at least one curved face, in particular a thin-walled component which, for example, may be provided in the form of a curved plate.

Accordingly, the structural component comprises a plurality of sides, which may also be referred to as "front end" or "front side". The terms side, front end or front side, in the context of the present disclosure, refer to lateral or end sections of the structural component which delimit the structural component in the width direction and/or the length direction. In some embodiments, the different sides of the structural component have different orientations. That is, the different sides of the structural component face or point toward different directions, in particular face or point toward different directions within a plane spanned by the width direction and length direction of the structural component. The sides may extend lineally, i.e. along a straight line, in particular along a straight line within the plane spanned by the width direction and the length direction of the structural component. Alternatively or additionally, the sides may extend along a curved line, in particular along a curved line arranged within the plane spanned by the width direction and the length direction of the structural component. According to some embodiments in which the structural component comprises only three sides of a different orientation, an angle included between two adjacent sides may be 60° or substantially 60°, but may also differ therefrom. According to such embodiments, the structural component may be formed in the shape of a substantially prism-shaped plate. According to some embodiments in which the structural component comprises only four sides of a different orientation, an angle included between adjacent sides may be 900 or substantially 90°, but may also differ therefrom. According to such embodiments, the structural component may be formed in the shape of a substantially cuboidal plate. According to some embodiments, the structural component may comprise more than four sides, in particular more than four straight sides. Accordingly, an angle included between two adjacent sides may be more than 90°, in particular between 900 and 180°, for example 120°.

At least one side of the structural component may have a length of 40 cm or substantially 40 cm. In some embodiments in which the structural component comprises four sides, each side may have a length of 40 cm or substantially 40 cm. In other words, the structural component may have a width and/or a length of 40 cm or substantially 40 cm. By this configuration, favorable bundling and stacking ability on euro pallets may be achieved. In the context of the present disclosure, the term "euro pallet" refers to a reusable transport pallet standardized according to EN 13698-1. In some embodiments, the structural component may have a thickness between 1 cm to 4 cm, in particular between substantially 1.5 cm to 2.5 cm, for example a thickness of 1.6 cm.

In some embodiments, the structural component may have a width and/or length which corresponds to an integer multiple or integer divisor of 40 cm, for example 20 cm or 10 cm.

In some embodiments, the structural component may have a width and/or length which corresponds to an integer multiple or integer divisor of a side length of a transport element or structural element, for example of a standardized large-capacity container, a reusable transport pallet or a transport surface of a transport system, in particular of an autonomous or self-driving transport system.

The structural component may be designed such that it sides enclose and/or laterally delimit an inner section. The inner section may be a planar extending section. Specifically, the inner section may be a section which extends between the sides of the structural component along its width direction and its length direction. The inner section may be plate-shaped or shell-shaped. The inner section may be a planar or curved plate, in particular a continuously extending plate. Alternatively or additionally, the inner section may be provided with a recess, which for example may form a handle for a user. In some embodiments, the inner section may comprise a grid pattern. In other words, the inner section may be provided with regularly arranged recesses. The inner section may be made of a transparent material. The inner section, in particular the recess provided therein, may be designed such that it is configured to receive functional elements, such as coupling elements for structurally connecting the structural component to other components, labels or stands.

In addition to the function of transmitting torques and forces, the inner section may serve to provide further or alternative functions. For example, the inner section may be intended for thermal regulation and/or thermal insulation. Accordingly, the inner section may have a double-walled structure and may form a double-walled insulation.

The sides may constitute a frame of the structural component, in particular a supporting or load-bearing frame. The inner section may be received within and detachably connected to the frame. Specifically, different and interchangeable inner sections may be received and fixed to the frame. The different inner sections may differ in terms of shape and/or function. For coupling the structural component to the further component, the structural component comprises the coupling units, each of which may constitute a structural interface. In other words, these structural interfaces are configured to couple the structural component to the further component, in particular in a form-fitting and/or force-fitting manner. The provided structural component is configured to be coupled to the further component, in particular to other components of the modular system, via its sides. To enable such a structural coupling, i.e. for structurally connecting the structural component to the further component, at least two sides of the structural component are provided with the coupling unit. In some embodiments, the inner section of the structural component may be provided with a further structural interface for connecting other components, in particular components of the modular system, to the structural component. For example, the inner section may be provided with a further structural interface for receiving a label or a receptacle for a label.

In the context of the present disclosure, the term "coupling unit" refers to a structural interface, by means of which the side of the structural component comprising the coupling unit is engageable, particularly in a form-fitting and/or force-fitting manner, with another component, in particular with another component of the modular system. More specifically, the coupling unit may be configured to be connectable to a correspondingly designed further coupling unit of the further component in a form-fitting and/or force-fitting manner. The further coupling unit of the further component may have an identical design compared to the coupling unit of the structural component.

As set forth above, the structural component comprises at least three sides. At least two of the at least three sides are provided with the coupling unit. Specifically, each one of the at least three sides may be provided with the coupling unit. For example, the structural component may comprise four sides, each of which is provided with the coupling unit.

Alternatively or additionally, the coupling units of the structural component, at least their first locking elements and/or their second locking elements, may be arranged point-symmetrically or mirror-symmetrically. For example, the second locking elements may be arranged point-symmetrically, wherein the first locking elements may be displaceable relative to one another in a point-symmetrical position, or vice versa. In some embodiments, in which the first locking elements and the second locking elements are displaceable relative to the sides, the first locking elements may be displaceable into a point-symmetrical position relative to one another, and the second locking elements may be displaceable into a point-symmetrical position relative to one another. By this configuration, modularity and flexibility of the structural component may be improved.

The coupling units may have an identical or different design. In the context of the present disclosure, the terms "identical design" or "structurally identical" may mean that two components are formed identical in view of their geometric design and function. In the following, the structural arrangement and function of the coupling units are further specified on the basis of a single coupling unit. The technical features described in this context may apply to all or only a part or only one of the plurality of coupling units of a structural component.

Referring to the coupling unit, a distinction may be made between different coupling states, specifically between an engagement state and a locked state of the coupling unit. In the context of the present disclosure, the term "engagement state" refers to a state of the coupling unit of the structural component in which the coupling unit is engaged, in particular in a form-fitting manner, with another component, in particular with a further coupling unit of the further component. In this state, the engagement between the coupling unit and the further coupling unit is releasable or disengageable upon displacing the structural component relative to the further component. For example, the engagement may be releasable upon displacing the structural component relative to the further component along a thickness direction and/or along a front end direction of the coupling unit, i.e. along a direction pointing away from the side and being perpendicular to the thickness direction.

The term "locked state" refers to a state of a coupling unit of the structural component in which the coupling unit is engaged with the further component, in particular with its further coupling unit, in particular in a form-fitting and/or force-fitting manner, such that the structural coupling therebetween cannot be released or disengaged upon relative movement between the structural component and the further component. In this state, a relative translatory movement between the structural component and the further component engaged therewith may be locked, in particular a relative movement along the thickness direction and/or along a width direction and/or along the front end direction of the coupling unit. The thickness direction of the coupling unit refers to the thickness direction of the structural component and the width direction of the coupling unit is perpendicular to the thickness direction and the front end direction of the coupling unit. Specifically, in the locked state, all translational degrees of freedom of movement between the coupled components may be locked or substantially locked, i.e. subjected to tolerances. In some embodiments, in the locked state, the structural component and the further component may be coupled to each other such that one rotational degree of freedom between the components is released, wherein in particular the other two rotational degrees of freedom may be locked, i.e. in directions perpendicular to the direction of the released rotational degree of freedom.

Specifically, one rotational degree of freedom may be released about an axis, in particular about a longitudinal axis of the first locking element, being parallel to the width direction of the coupling unit, wherein in particular the other two rotational degrees of freedom, i.e. rotational degrees of freedom about axes being parallel to the thickness direction and the front end direction, may be locked. In the locked state, the coupling unit may constitute or form an articulated fixture or joint unit, for example in the form of a hinge joint, which in particular comprises or defines a radial bearing about an axis and/or an axial bearing along the same axis.

In other words, the coupling unit may be configured to release a rotational degree of freedom about an axis, i.e. a pivot axis, which is parallel to the width direction of the coupling unit, in a coupled state, in particular in the engagement state and/or locked state, in which the coupling unit is engaged with a correspondingly designed, in particular identically designed, further coupling unit of the further component. By this configuration, a container with a hinged lid may be built or created by means of the structural component. In the couple state, the structural component and the further component may be pivotable relative to one another about the pivot axis by at least 200° or by at least 210°, in particular by at least 240°.

The component comprises the at least one first locking element and the at least one second locking element which is designed correspondingly to the first locking element.

The first and the second locking element may define the pivot axis, which in particular may coincide with a longitudinal axis of the first or the second locking element. The first locking element may be provided in the form of a pin, bold or latch. In some embodiments, the first locking element has, at least partly, a cylindrical shape. The second locking element may have a shape correspondingly designed to the shape of the first locking element. Specifically, the second locking element may be provided with a recess which is correspondingly designed to the first locking element in order to, at least partly, receive the first locking element therein. For example, the second locking element may be formed by a projection protruding from the side. The projection may be provided with a through hole forming a receiving space for the first locking element. In particular, the through hole may extend along the width direction of the coupling unit. In other words, a longitudinal axis of the through hole may extend in parallel to the width direction of the coupling unit. The shape of the receiving space of the second locking element may be adapted to the shape of the first locking element. A geometrical design of an inner surface of the receiving space of the second locking element may be adapted to the shape of the outer surface of the first locking element. In some embodiments, the first locking element may have the design of the second locking element as described above and the second locking element may have the design of the first locking element as described above.

The first or the second locking element may be integrally formed at their associated side. For example, the sides together with their at least one first or at least one second locking element may be manufactured by injection molding or by additive manufacturing to provide an integral design of these components.

The first and the second locking element are displaceable, actuatable or movable relative to one another, in particular translationally displaceable and/or rotationally movable relative to one another. For example, the first and second locking elements may be translationally displaceable relative to one another along the width direction of the coupling unit. The coupling unit may be designed such that the first locking element is adjustable, in particular displaceable, relative to its associated side of the structural component and thus relative to the second locking element. Alternatively or additionally, the coupling unit may be designed such that the second locking element may be adjustable, in particular displaceable, relative to it associated side of the structural component and thus relative to the first locking element.

The first and the second locking element can be positioned relative to one another into the release position. In the context of the present disclosure, the term "release position" refers a state of the coupling unit that allows the coupling unit of the structural component to be moved or positioned into the engaged state with another component or to release such an engaged state. Accordingly, in the release position, the first and the second locking element are configured to allow a translational relative movement between the coupling unit and the further coupling unit of the further component, in particular along the thickness direction and/or along the front end direction of the coupling unit.

As described above, the first and the second locking element are displaceable or adjustable relative to one another into the first locking position and the second locking position. Each of the first and the second locking position is intended for allowing to connect the structural component to the further component, in particular to form-fittingly and/or force-fittingly connect the coupling unit to the further coupling unit of the further component.

In the context of the present disclosure, the term "locking position" refers to a position of the first and the second locking element relative to one another that enables and underlies the locked state of the coupling unit. In the locking positions, the first and the second locking element are configured to lock at least one or all translational relative movements between the coupling unit and the further component, in particular a relative movement along the thickness direction and/or along the front end direction of the coupling unit. In the locked state of the coupling unit, the first and the second locking element are arranged relative to one another in the first or the second locking position. In the engagement state, however, the first and the second locking element are arranged relative to one another in the release position.

Starting from the release position of the locking elements, the locking elements are displaceable relative to one another into the first locking position by actuating, in particular by moving or displacing, the first or the second locking element in the first locking direction. Accordingly, the first and the second locking element are displaceable relative to one another from their release position into the second locking position by actuating, in particular by moving or displacing, the first or the second locking element in the second locking direction. The first and the second locking direction define in particular a movement path along which the first or the second locking element is to be moved in order to attain the desired locking position. The first and the second locking direction may be opposite directions. In other words, the first locking direction may point in a direction opposite to the second locking direction. In some embodiments, the first and the second locking direction may be arranged parallel to one another.

Each one of the first and the second locking position may constitute an end position. In other words, the first and the second locking position may constitute end positions when actuating the first or the second locking element. In the context of the present disclosure, the term "end position" refers to a position beyond which an element cannot be moved relative to its support or bearing. For example, when moving an element in a first direction until it reaches an end position, this element cannot be moved further along the first direction, i.e. cannot be moved beyond its end position. That is, the first or the second locking element cannot be moved beyond their corresponding locking position when being moved in the first or the second locking direction. In this way, the first and the second locking element may be prevented from being subjected to an unintended excessive actuation and thus from being unintentionally disengaged from one another, which may cause an unintended disengagement of components. In some embodiments, each one of the first and the second locking direction may be arranged parallel to the width direction of the coupling unit, i.e. transverse to the thickness direction and the end face direction.

In some embodiments, the structural component is intended to be structurally coupled to a further component, in particular to a further structural component of the modular system. The further component can comprise a structurally identical further coupling unit on at least one side thereof. The coupling unit may be configured to be form-fittingly connectable to the structurally identical further coupling unit of the further component. In some embodiments, the coupling unit may be designed and configured such that, in the coupled state in which the coupling unit is engaged with the further coupling unit, i.e. in the engagement state or the locked state, displacing the first and the second locking element relative to one another causes displacement of further locking elements of the further coupling unit relative to one another. By this configuration, a particularly simple assembly and disassembly of the structural component may be ensured. According to some embodiments, the coupling unit may be designed such that, in the coupled state, displacing the first locking element relative to the second locking element of the coupling unit causes a displacement of the further first locking element of the further coupling unit. Specifically, this may be caused by the first locking element being pressed against the further first locking element of the further coupling unit.

For connecting the structural component to the first structural component, the following procedure may be applied. At first, the locking elements of each one of the coupling unit and the further coupling unit may be displaced into their corresponding release positions. Then, the structural component and the further structural component may be engaged with one another such that each one of the coupling unit and the further coupling unit are in the engaged state relative to one another. Then, the first and the second locking elements of the coupling unit and the further coupling unit may be displaced relative to one another into the respective first or second locking position. By doing so, the coupling unit and the further coupling unit may attain their locked state. The coupling unit may be configured such that, by moving the first and the second locking element of the coupling unit relative to one another into their first or second locking position, the locking elements of the further coupling unit are caused to move relative to one another into their second or first locking position. In other words, in the coupled state of the coupling unit and the further coupling unit, adjusting the position of the first and the second locking element of the coupling unit relative to one another may cause the locking elements of the further coupling unit to be adjusted, and vice versa.

The coupling unit may comprise at least two receiving spaces, which may also be referred to as receptacle. The receiving spaces can refer to distinct spaces or portions, i.e. which are spaced apart from one another, and in which locking elements of the further coupling unit of the further component are arranged in the engagement state. The receiving spaces may be arranged adjacent to a second locking element. Specifically, a first receiving space and a second receiving space may be arranged on opposite sides of the second locking element. According to some embodiments, each of the at least one second locking element may be arranged adjacent to a first receiving space on one side and to a second receiving space on an opposite side. In this configuration, one receiving space may be associated to several second locking elements, in particular when being interposed between two second locking elements. In the first locking position, the first locking element, in particular each one of the at least one first locking element, may, at least partly, protrude into an associated first receiving space. In the second locking position, the first locking element, in particular each of the at least one first locking element, may, at least partly, protrude into an associated second receiving space. Alternatively or additionally, in the release position, the first locking element, in particular each of the at least one first locking element, may be arranged spaced apart from or adjacent to the first and the second receiving space associated thereto. Specifically, in the release position, the first locking element may be entirely arranged within the second locking element associated thereto. In the first locking position and in the second locking position, the first locking element may protrude, at least partly, from the second locking element, in particular from the second locking element into an associated receiving space.

In some embodiments, the coupling unit may comprise an actuation mechanism, which may also be referred to as an actuation unit. The actuation mechanism may be configured to translate or transfer an actuation or a movement of a control element into an actuation or movement of the at least one first locking element and the at least one second locking element relative to one another, in particular of the first or the second locking element. In other words, an actuation of the control element may cause actuation, i.e. movement, of the first locking element relative to the second locking element, or vice versa. In some embodiments, an actuation mechanism may be provided that transfers actuation of a control element into actuation of first or second locking elements of a plurality of coupling units.

In the context of the present disclosure, the term "control element" refers particularly to a mechanical interface, by means of which an installer can act upon or manipulate the coupling unit in order to displace the locking elements relative to one another. The control element can in particular be designed such that it is positively engageable with a tool, for example with a screwdriver. In this way, actuation of the control element may be more convenient for an installer and/or unintentional actuation may be prevented.

In general, the actuating mechanism may be configured to transfer actuation of the control element into actuation of the at least one first and/or second locking element, in particular of a plurality of first and/or second locking elements. According to some embodiments, the actuation mechanism may be configured such that an actuation of the control element is transferred into an actuation of at least two first and/or at least two second locking elements. In other words, by actuating the control element, at least two first or second locking elements may be moved, in particular translationally moved. In this way, a plurality of locking elements may be actuated simultaneously by means of a single actuating element, which may simplify the assembly or disassembly of the structural component. In some embodiments, locking elements of a plurality of coupling units, in particular of two coupling units arranged relative to one another in the coupling state, may be actuated simultaneously by actuating a single control element.

The actuating mechanism may be accommodated, in particular entirely accommodated, in the side of the structural component associated with or comprising the coupling unit such that the control element may be accessible to an installer, i.e. accessible from outside the structural component. According to some embodiments, the actuating mechanism may comprise a first and a second control element, wherein the first control element may be arranged at a first face of the structural component and may in particular be accessible from this first face, and the second control element may be arranged at an opposite second face of the structural component and may in particular be accessible from this second face.

According to some embodiments, the actuating mechanism may be designed and configured to transfer a translational or rotational actuation of the control element, i.e. a translational displacement or a rotation of the control element, into a translational movement of the at least one first and/or the at least one second locking element. Alternatively or additionally, the actuation mechanism may be configured to transfer a translational or rotational actuation of the control element into a rotational movement of the at least one first or the at least one second locking element.

In some embodiments, the actuating mechanism may comprise at least one blocking unit which may be arranged to block displacement of the first and/or the second locking element. In this way, the first and the second locking element may be prevented from being unintentionally displaced relative to one another. In particular, the locking unit may be arranged to lock the first and the second locking element relative to one another in the release position and/or the first locking position and/or the second locking position. The blocking unit may be operated between a blocking state and a releasing state. In the blocking state, the blocking unit may be configured to block displacement of the locking elements. In the releasing state, the blocking unit may be configured to release movement of the locking elements.

Alternatively or additionally, the actuating mechanism may comprise at least one resistance unit which may be configured to set a minimum actuation force of the control element. In the context of the present disclosure, the term "minimum actuation force" refers to a minimum force required to actuate the control element in a desired actuation direction. That is, an actuation force acting upon the control element needs to reach the minimum actuation force with respect to its direction and absolute value to actuate the control element and thus to displace the locking elements. The minimum actuation force thus describes a resistance, in particular a mechanical resistance, such as a holding force, which must be reached or overcome in order to actuate the control element and thus to displace the first and second locking elements relative to one another. In other words, the resistance unit is configured to allow actuation of the control element to move the first and the second locking element relative to one another when a directed actuation force acting upon the control element reaches or exceeds a predetermined threshold value, i.e. the minimum actuation force.

The resistance unit may be designed and configured to set a minimum actuation force of the control element in dependence on a relative position between the first and the second locking element. In other words, the minimum actuation force, i.e. the force which needs to be applied to actuate the control element and thus to move the first and the second locking element relative to one another, may depend on the position of the first and the second locking element relative to one another. The minimum actuation force of the control element may be greater in a state, in which the first and the second locking element are arranged relative to one another in the first locking position and/or the second locking position and/or the release position, compared to a state, in which the first and the second locking element are arranged relative to one another between the first locking position and the release position and/or between the second locking position and the release position. By this configuration, unintentional actuation of the control element may be prevented. In some embodiments, it may be ensured that the first and the second locking element are reliably displaced relative to one another into predefined positions and are prevented from being unintentionally removed therefrom. In some embodiments, by such a configuration, gradual or stepwise displacement may be enabled.

In some embodiments, the resistance unit may comprise a guide pin and a spring element bearing thereon, wherein in particular the spring element pushes against the guide pin and is elastically deformable or deformed. Upon actuating the control element, the guide pin and the spring element are moved relative to one another. By this configuration, the control element is subjected to a mechanical resistance. The spring element may be provided with predefined notches, for example three notches which may be spaced apart from one another. Each one of the notches may be associated to one of the following positions: the first locking position, the second locking position and the release position. In other words, in a state in which the guide pin is arranged in a notch of the spring element, the first and the second locking element may be arranged in the first locking position or the second locking position or the release position. Positioning the guide pin in the notch of the spring element may cause that, in this state, a mechanical resistance required for actuating the control element and accordingly the minimum actuation force are increased. In other words, in a state of the actuation mechanism in which the guide pin is arranged in a notch of the spring element, a higher actuation force is required to actuate the control element compared to a state of the actuation mechanism in which the guide pin is not arranged in a notch, for example is arranged between notches. In some embodiments, adjustability of the actuation force may be provided by a configuration in which the spring element has a wedge-shape or any other suitable protruding shape and in which the guide pin interacts, in particular can be pressed against, a wedge surface of the spring element. The spring element and the guide pin may be designed in such that a movement direction of the guide pin induced by actuation of the control element is perpendicular to a deflection movement of the spring element and/or is perpendicular to a spring force acting upon the guide pin. In this way, damages to the spring element may be prevented when the control element is excessively and/or unintentionally actuated.

The structural component may be made of a single material, in particular of plastic. That is, all parts of the structural component may be made of the same material. By this configuration, a high material purity may be achieved, which may affect recyclability of the structural component. Accordingly, the structural component may be subjected to a recycling process with no or minimal additional effort. After reaching an intended product lifetime and/or in the event of damage, the structural component may therefore be subjected directly to a shearing process, for example to a shredding process, either individually or in combination with other structural components, which in particular form an assembly. A costly separation process may thus be omitted. The resulting granulate may then be used as a starting material or semifinished product for manufacturing new structural components or other products.

At least one or more sides and their associated at least one first locking element and at least one second locking element may be made of the same material. It has been found that if at least the sides and their corresponding locking elements are made of the same material, a uniform thermal expansion of the structural component may be ensured so that the structural component may be reliably connected to and disconnected from other components over a broad temperature spectrum. In some embodiments, the actuation mechanism and/or the inner section of the structural component may be made of the same or a different material as the sides and the locking elements.

As set forth above, the structural component, in particular its sides and locking elements, may be made of a plastic material, in particular of a thermoplastic material. For example, polypropylene and/or an acrylonitrile-butadiene-styrene copolymer, in particular ABS plastics, and/or polyamide and/or polylactide may be used. The use of a plastic material may enable to reuse the material, in particular in several cycles. Accordingly, a structural component that is damaged or has reached an intended lifetime may be crushed into granulate, which then may serve as a semi-fished product for producing a new structural component, for example by injection molding. Alternatively or additionally, the structural component may be made of wood. In some embodiments, structural components of a single assembly unit may be made of different materials.

The structural component may be designed such that the actuation mechanism and/or the first locking element and/or the second locking element are/is arranged entirely within the structural component. The actuation mechanism and/or the first locking element and/or the second locking element may be accommodated in the structural component such that they cannot be non-destructively disengaged therefrom. For example, the structural component may comprise two plate halves or shell halves between which the actuating mechanism and/or the first locking element and/or the second locking element are/is arranged and which are integrally connected to one another or are connected to one another by a material bond. By this configuration, the actuation mechanism and/or the first locking element and/or the second locking element may be held in a form-fitting manner within the structural component.

According to some embodiments, the structural component may be manufactured by means of an additive process, in particular by means of 3D printing. In some embodiments, individual components of the structural component, for example the plate halves or shell halves, may first be produced by injection molding and then joined together, in particular welded. Ultrasonic welding may be used for example. Alternatively or additionally, the plate halves or shell halves may be joined by means of adhesive bonding, or by means of another suitable joining technique. For example, at first, the two plate halves or shell halves may be provided. Then, the at least one actuation mechanism and the first or second locking elements may be placed therein before joining the two halves.

Furthermore, an assembly unit is provided, which in particular is intended for use in storage systems or bundling systems or transportation systems or structural installations. The assembly comprises at least two structural components having the features described above which are coupled to one another. The structural components can be connected to one another via one of their coupling units, in particular in a form-fitting and/or force-fitting manner. The assembly unit may form a receiving means for goods and may in particular be provided in the form of a bin, a container, a plate, etc. In some embodiments, the assembly unit may form an object for structural installations or be a structural installation, such as a panel, a cladding element, a furniture item, in particular a chair, a table, a counter, etc. In some embodiments, the assembly unit may form a stand or a part of a stand, in particular of a trade fair.

According to some embodiments, the assembly unit may comprise at least five coupled structural components, each of which may comprise four sides with a coupling unit. Four structural components may be coupled at three different sides to a further structural component, respectively, and one structural component may be coupled at each one of its four sides to a further structural component, respectively. By this configuration, a container, in particular a container with an opening, may be created. Such a container may comprise or consist of at least five structurally identical structural components. In some embodiments, the container may be provided by means of five structurally different structural components. In order to provide such a container with a pivotable lid, a further structural component may be provided which is connected at one side to a side of one of the five structural components in a form-fitting manner such that it is pivotable about a width direction of the side.

The structural components of the assembly unit may be designed differently in terms of their shape and function. For example, a length and/or width of a first structural component of the assembly unit may be larger or smaller compared to a second structural component of the assembly unit. The first and the second structural component may be coupled to one another along their sides. In some embodiments, the coupled side of the first structural component may be larger, in particular twice as large or substantially twice as large, as the coupled side of the second structural component. Accordingly, the first structural component may be coupled to two second structural components at the same side. The sides of the first and the second structural component may be coupled such that they are aligned laterally. In some embodiments, the first and the second structural component may be configured such that their coupled sides are not aligned laterally.

The assembly unit may be constructed from components of a modular system comprising the first and the second structural component. The modular system may comprise further components that may be installed in the assembly unit. For example, the modular system may include structural components of different lengths and widths which may be connectable to each other via their sides. In some embodiments, the modular system may comprise a connector, by means of which two structural components may be structurally coupled to one another via their inner sections. In some embodiments, the modular system may comprise a folding connector configured to be interposed between two sides of two structural components to be connected. The folding connector may enable the two structural components to be pivotable relative to each other by more than 300°, in particular by 360° or substantially 360°.

Furthermore, a further assembly unit is proposed. The further assembly unit is intended for use in storage systems or bundling systems or transport systems or structural installations. The further assembly unit comprises a first and a second plate-shaped or shell-shaped further structural component with at least three sides, wherein at least two sides are provided with correspondingly designed coupling elements. The coupling elements of a first side of the first further structural component are engaged with the correspondingly designed coupling elements of a second side of the second further structural component. In some embodiments, the further assembly unit comprises a coupling rod which is correspondingly designed to the coupling elements and which releasably couples the coupling elements of the first side to the coupling elements of the second side in a form-fitting manner. The coupling rod comprises a first connecting element at a first end portion and a correspondingly designed second connecting element at an opposing second end portion. The first and the second further structural component may be of a structurally identical design.

The connecting elements of the coupling rod may enable to couple a plurality of coupling rods to one another. By this configuration, several further structural components arranged in one plane may be interconnected and detached from one another in a simple and effort-reduced manner.

To release the form-fit connection between the coupling elements, the coupling rod may be moved along its longitudinal direction, in particular in both a first and an opposite second direction along the longitudinal direction, relative to the coupling elements. For doing so, the coupling elements may be provided with cylindrical recesses. Specifically, longitudinal axes of the individual cylindrical recesses may coincide.

Compared to the structural component described above, the further structural component may not be equipped with first locking elements. Thus, the first and the second further structural component may differ from the structural component described above with respect to the elements provided at the sides for coupling. Besides, the first and the second further structural component may have the features described above in connection with the structural component. For example, the sides of the further structural component may accordingly form a frame as described above. In some embodiments, the first and the second further structural component may have an inner portion as described above. As such, the inner portion of the first and the second further structural component may be designed correspondingly to the inner portion of the structural component as described above. In some embodiments, the further structural components, i.e. the first and the second further structural component, may be designed in view of its dimensions correspondingly to the preceding structural component. Accordingly, the further structural component may be provided with four sides and may have a cuboid shape. Alternatively or additionally, the coupling elements of the first and/or the second further structural component may be arranged point-symmetrically, in particular in a longitudinal section profile, i.e. perpendicular to the thickness direction, or mirror-symmetrically, in particular along a diagonal in the longitudinal section profile.

The coupling elements of the first and the second further structural component may be designed correspondingly to the second coupling elements of the structural component described above. The first and the second further structural component may be form-fittingly coupled to the previously described structural component, in particular by means of the at least one first locking element of the above-described structural component. For doing so, the above-described structural component may be brought into an engaged state with the first or the second further structural component. Thereafter, the at least one first locking element may be displaced into its first or second locking position to attain a locking state between the components.

The first connecting element of a first coupling rod may be form- and/or force-fittingly connected to the second connecting element of a second coupling rod. The first connecting element may be provided in the form of a threaded rod and the second connecting element may be provided in the form of a correspondingly designed threaded hole, or vice versa. By this configuration, multiple coupling rods can be screwed together. In the area of the first and the second connection element, the coupling rod may have a cross-sectional profile, the outer contour of which is non-circular. For example, the outer contour of the cross-sectional profile may form a polygon, for example a quadrangle or hexagon. By this configuration, an installer may easily apply a torque onto coupling rods to be connected or disconnected, for example, by using a wrench.

The coupling elements may be integrally provided or formed at the further structural component. The further structural component may be provided in the form of an integral component. In some embodiments, the further structural component may be made of the same material as the above-described structural component. The coupling rod may be made of the same material as the first and the second further structural component.

The coupled first and second further structural components may be pivotable relative to one another by substantially 210° or substantially 240° about a pivot axis extending along the longitudinal axis of the coupling rod.

BRIEF DESCRIPTION OF THE DRAWINGS

The present disclosure will be more readily appreciated by reference to the following detailed description when being considered in connection with the accompanying schematic drawings in which.

DETAILED DESCRIPTION

Figure 1:
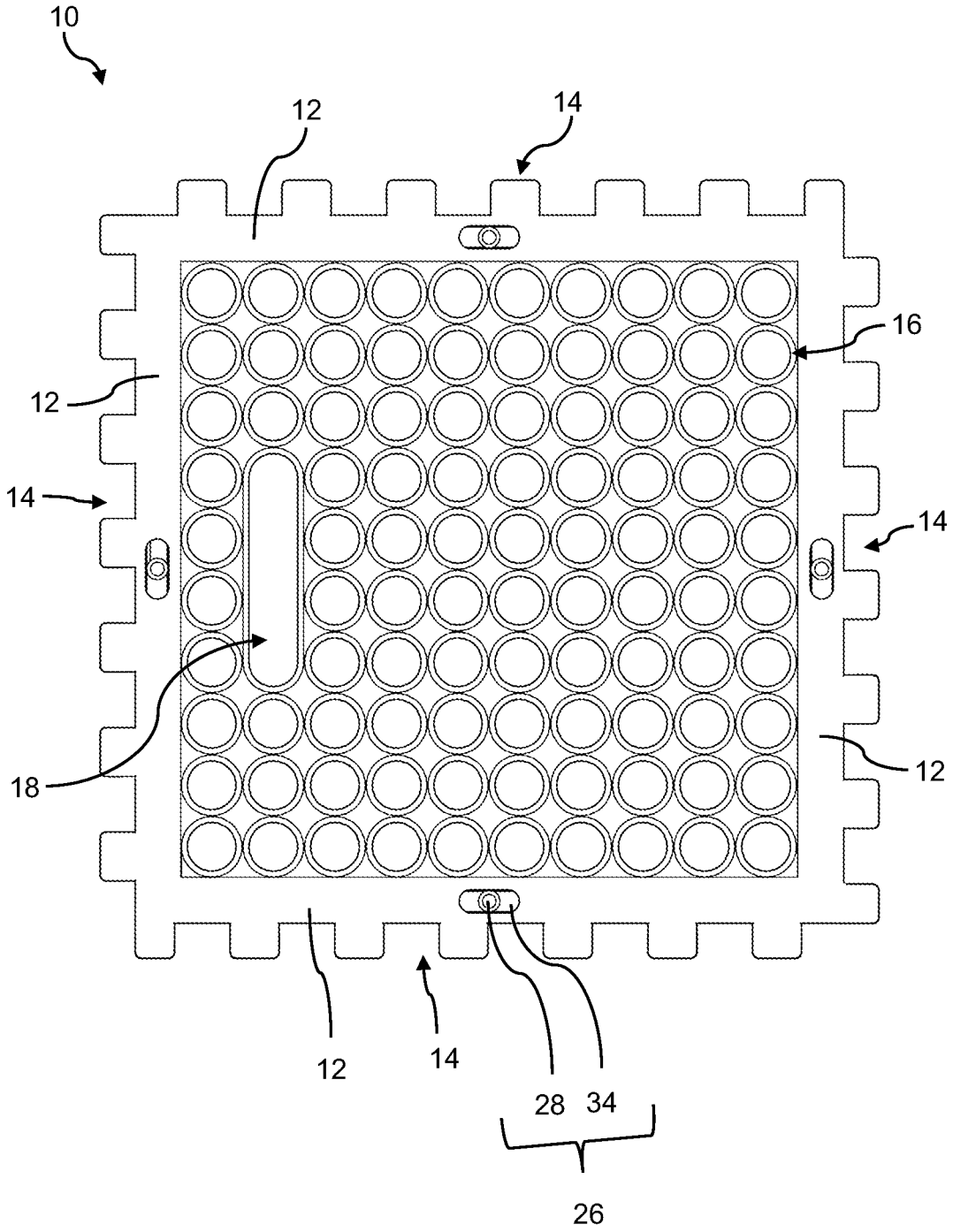
FIG. 1 is a top view of a structural component of a modular system according to an embodiment.

In the following, the present disclosure will be explained in more detail with reference to the accompanying Figures. In the Figures, like elements are denoted by identical reference numerals and repeated description thereof may be omitted in order to avoid redundancies.

FIG. 1 depicts a structural component 10 according to some embodiments. The structural component 10 constitutes a component of a modular system. The structural component 10 is intended to be structurally connected to structurally identical or other components of the modular system to form assembly units to be used in storage systems or bundling systems or transportation systems or structural installations. Such assembly units may form receiving means for goods and may be provided, for example, in the form of a container or a transport box.

In the shown configuration, the structural component 10 is plate-shaped. In some embodiments, the structural component 10 may be shell-shaped. The structural component 10 includes four sides 12, wherein an angle included between two adjacent sides is 90°. The structural component 10 has a length and width of 40 cm and a thickness of 1.6 cm.

Each side 12 is provided with a coupling unit 14. In the shown configuration, the different sides 12 and different coupling units 14 of the structural component 10 are structurally identical, i.e. are identical in construction. The sides 12 form a frame which encloses and thus laterally delimits an inner section 16 of the structural component 10. In the shown configuration, the inner section 16 is integrally connected to the frame formed by the sides 12. In some embodiments, the inner section 16 is provided in the form of a plate-like structure provided with regular recesses, in particular a grid-like structure. In some embodiments, the inner section 16 is provided with a further recess forming a handle 18. In some embodiments, the inner section may be detachably and interchangeably received in and connected to the frame. In some embodiments, the inner section may be made of a transparent material and/or be designed in the form of a solid plate.

In the shown configuration, the structural component 10 is made of a single material. In other words, all elements of the structural component 10 are made of the same material, more specifically of a plastic material, in particular polypropylene. In addition to elements shown in the configuration depicted in FIG. 1, the structural component 10 may comprise further elements that may be made of the same or a different material.

The structural component 10 is configured to be coupled to other components via its sides 12, in particular to structurally identical further structural components. For enabling such structural coupling, i.e. for structurally connecting the structural component to a further component, the coupling units 14 are provided. In other words, the coupling units 14 are configured for structurally connecting, in particular form-fittingly connecting, the structural component 10 to further components, in particular to a further structural component of the modular system.

Figure 2:
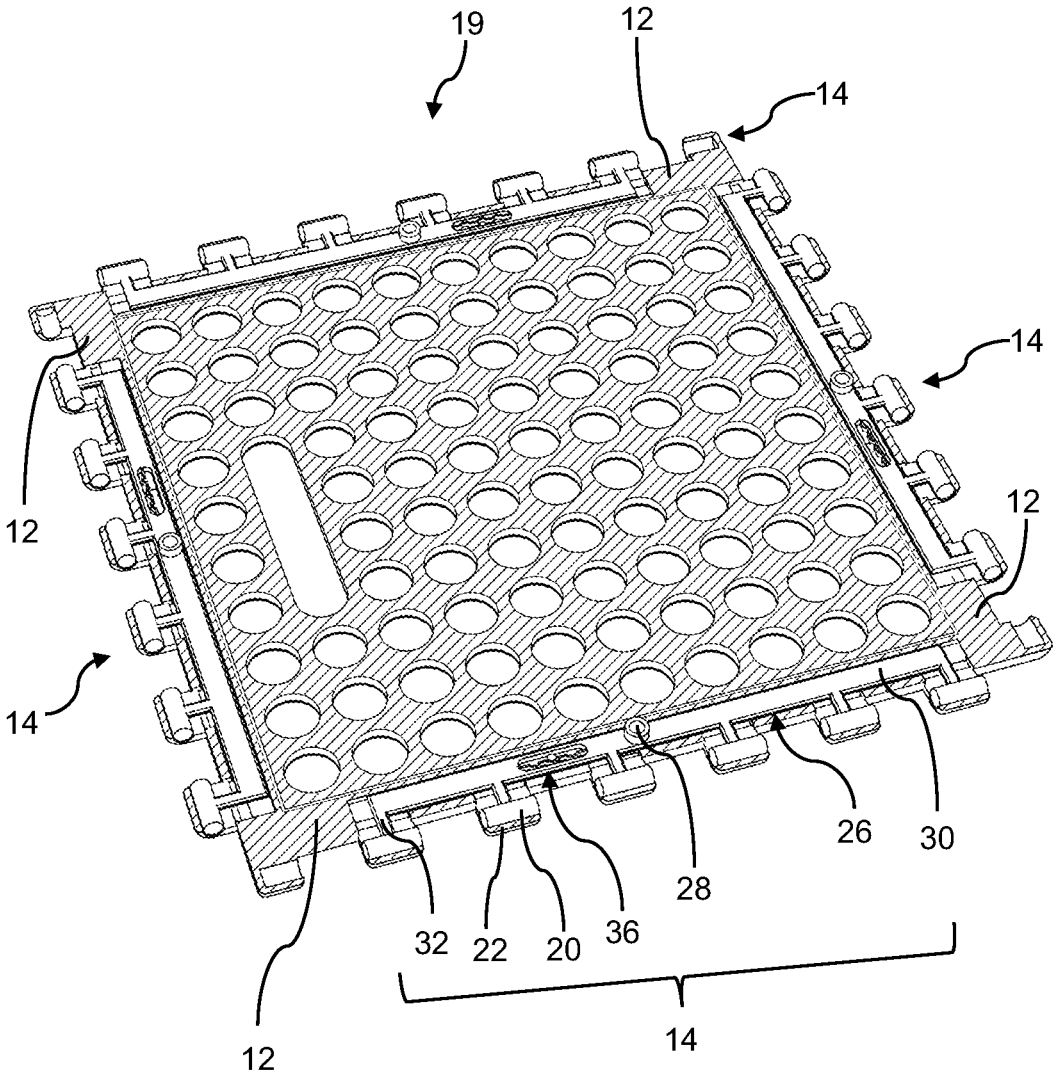
FIG. 2 is a perspective view of a longitudinal section of the structural component shown in FIG. 1.

For better visualization of the coupling units 14, a longitudinal section of the structural component 10 is shown in FIG. 2, in which a lower plate half 19 is depicted and a mirror-symmetrical upper plate half is omitted. The structural and functional configuration of the coupling units 14 is described in the following exemplary with reference to one single coupling unit 14 which applies correspondingly to the other coupling units 14 of the structural component 10. Thus, the features described hereinafter in this context apply likewise to and are to be considered as disclosed for to the other coupling units 14.

Figure 3:
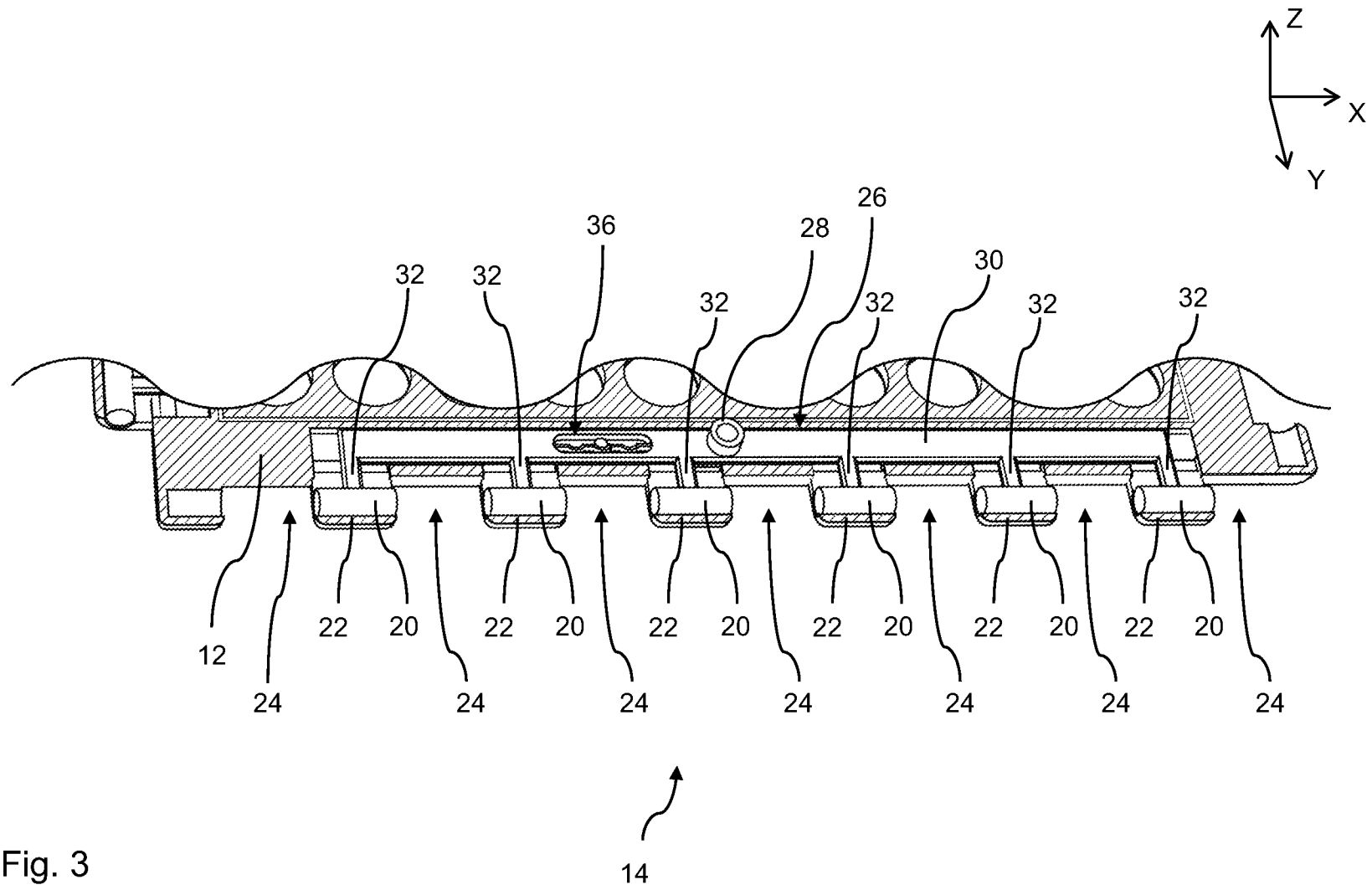
FIG. 3 is an enlarged view of a longitudinal section of a coupling unit of the structural component.

As depicted in FIG. 3, the coupling unit 14 comprises a plurality of first locking elements 20 and a plurality of correspondingly designed second locking elements 22 in corresponding numbers. In the shown embodiment, the coupling unit 14 comprises six first locking elements 20 and six second locking elements 22. In some embodiments, the coupling unit 14 may comprise more or less than six first and second locking elements 20, 22, for example just one first and just one second locking element 20, 22. The first and the second locking elements 20, 22 are made of the same material as the other elements of the structural component 10, in particular as the side 12.

The first locking elements 20 are provided in the form of a cylindrical pin or bolt whose longitudinal axis extends parallel to a width direction X of the side 12 and the coupling unit 14. The second locking elements 22 are formed by projections protruding from the side 12 in a front end direction Y. In some embodiments, each second locking element 22 is provided with a through hole which is correspondingly designed to the first locking elements 20. The through holes extend along the width direction X of the coupling unit 14 and serve as receiving seats or spaces for the first locking elements 22.

The first locking elements 20 are displaceable relative to the second locking elements 22, in particular translationally movable along the width direction X of the coupling unit 14. In other words, the first locking elements 20 are slidably mounted, in particular translationally supported, within the structural component 10. The second locking elements 22 are integrally formed at the side 12 and accordingly are not displaceable relative thereto. The first locking elements 20 are displaceable relative to the second locking elements 22 into different positions. More specifically, the first locking elements 20 are movable relative to the second locking elements 22 between a first locking position, a release position and a second locking position.

In the shown configuration, the coupling units 14 and correspondingly their components are provided such that they are arranged point-symmetrically, as can be gathered from FIG. 2. Specifically, the coupling units 14 are provided such that their elements are movable into a point-symmetrical position relative to one another. More specifically, the second locking elements 22 are arranged point-symmetrically and the first locking elements 20 are displaceable in a point-symmetrical position. In some embodiments, the coupling units 14 may be arranged mirror-symmetrically, for example along a plane parallel to the thickness direction of the structural component 10 and in particular along a diagonal of the structural component 10.

Figure 4:
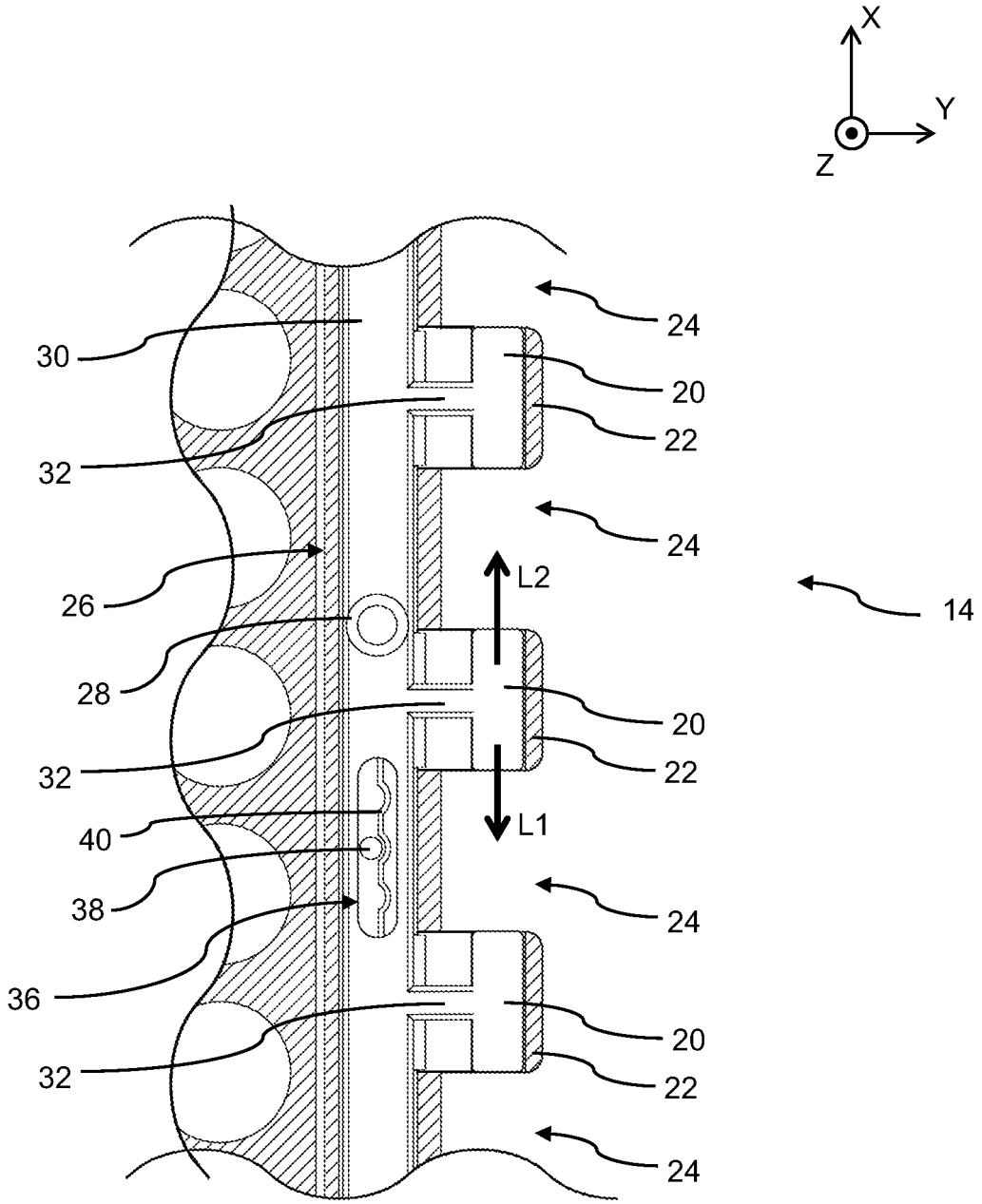
FIG. 4 is an enlarged view of a longitudinal section of the coupling unit of the structural component in a release position.

FIG. 4 shows the coupling unit 14 in a state in which its first locking elements 20 are arranged in the release position. In this state, each one of the first locking elements 20 is received within an associated second locking element 22.

Figure 5:
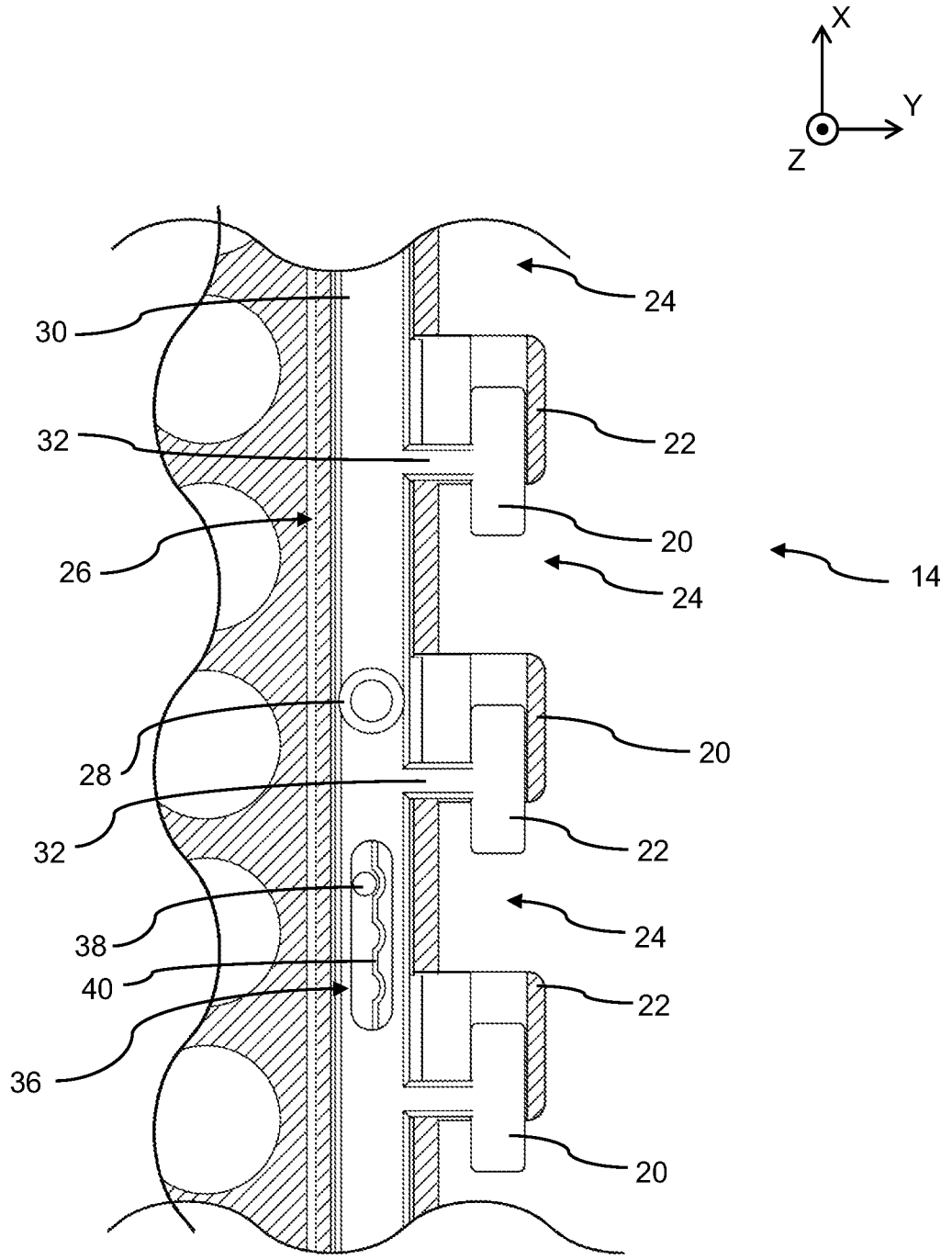
FIG. 5 is an enlarged view of a longitudinal section of the coupling unit in a first locking position.

For providing a form-fit connection between the structural component 10 and the further component, the first locking elements 20 are displaceable relative to the second locking elements 22 from the release position into the first locking position by actuating, in particular by moving, the first locking elements 20 relative to the second locking elements 22 in a first locking direction L1, as indicated by an arrow in FIG. 4. In other words, by moving the first locking elements 20 from their release position along the first locking direction L1, they are moved into their first locking position. The first locking position forms an end position of the first locking elements 20. FIG. 5 depicts a state in which the first locking elements 20 are arranged in the first locking position.

Figure 6:
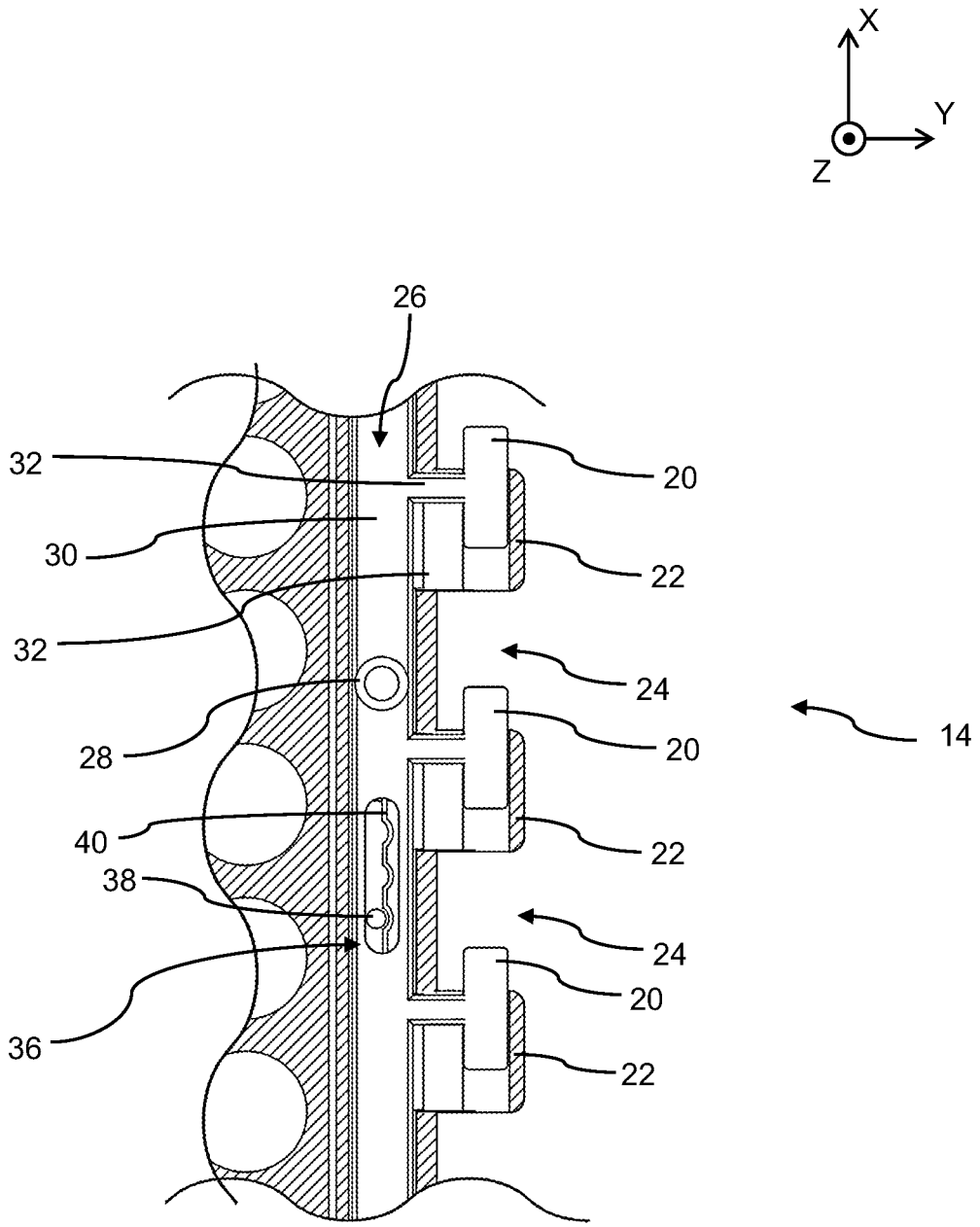
FIG. 6 is a longitudinal sectional view of the coupling unit in a second locking position.

In some embodiments, for providing the form-fit connection, the first locking elements 20 are displaceable relative to the second locking elements 22 from the release position into the second locking position by actuating, in particular by moving, the first locking elements 20 relative to the second locking elements 22 in a second locking direction L2, as indicated by a further arrow in FIG. 4. In other words, by moving the first locking elements 20 from their release position into the second locking direction L2, they are moved into their second locking position. The second locking position forms another end position of the first locking elements 20, in particular an opposed end position. FIG. 6 depicts a state in which the first locking elements 20 are arranged in the second locking position.

In the shown configuration, the first locking direction L1 and the second locking direction L2 point in opposite directions. In some embodiments, the first locking direction L1 and the second locking direction L2 are arranged parallel to the width direction X. In some embodiments, the first locking direction L1 and the second locking direction L2 are arranged perpendicular to the front end direction Y and to a thickness direction Z of the coupling unit 14.

As can be gathered from FIG. 4, FIG. 5, and FIG. 6, the coupling unit 14 comprises a plurality of recesses in the form of receiving spaces 24 which are arranged adjacent to the second locking elements 22. More specifically, along the width direction X of the coupling unit 14, each second locking elements 22 is arranged adjacent to a first receiving space 24 on one side and to a second receiving space 24 on an opposite side. As shown in FIG. 4, in the release position, each first locking element 20 is arranged adjacent to or spaced apart from those receiving spaces 24, which adjoin the second locking element 22 accommodating the first locking element 20. As shown in FIG. 5, in the first locking position, each first locking element 20 protrudes partly into the first receiving spaces 24. In the second locking position, as shown in FIG. 6, each first locking element 20 protrudes partly into the second receiving spaces 24.

As can be gathered from FIG. 3, the coupling unit 14 further comprises an actuation mechanism 26 configured to translate an actuation of a control element 28 into an actuation of the first locking elements 20 relative to the second locking elements 22. Specifically, the actuation mechanism 26 is configured to translate a translational movement of the control element 28 in a direction along the width direction X of the coupling unit 14 into a translational movement of the first locking elements 20 relative to the second locking elements 22 along the width direction X of the coupling unit 14.

Figure 7:
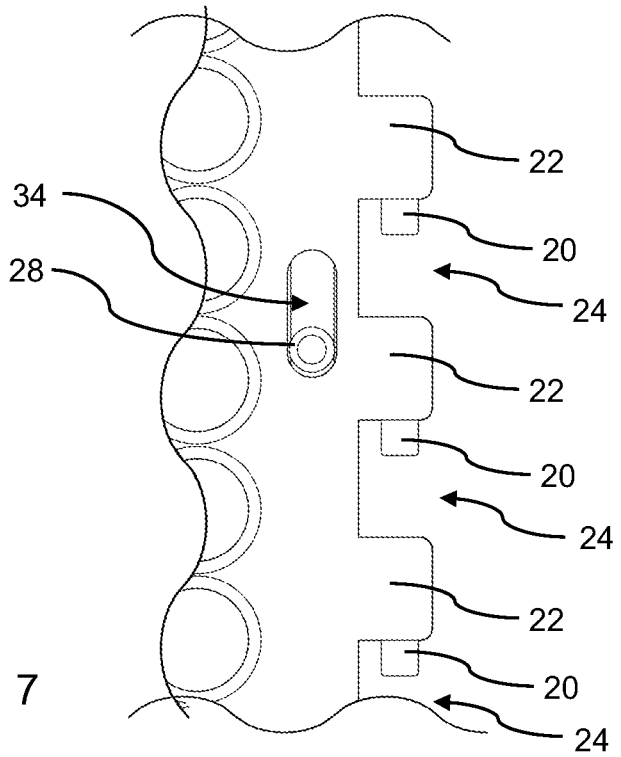
FIG. 7, FIG. 8, and FIG. 9 are enlarged views of a control element of the coupling unit in different positions.
Figure 8:
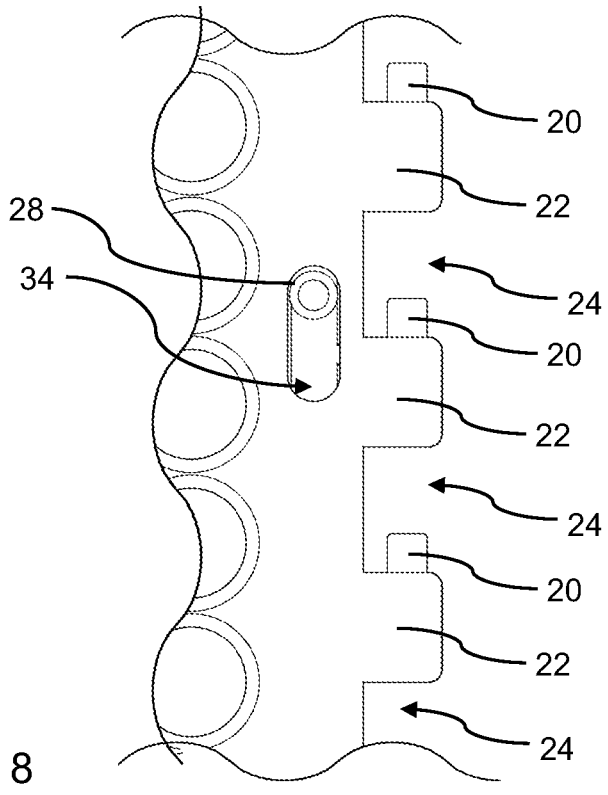
Figure 9:
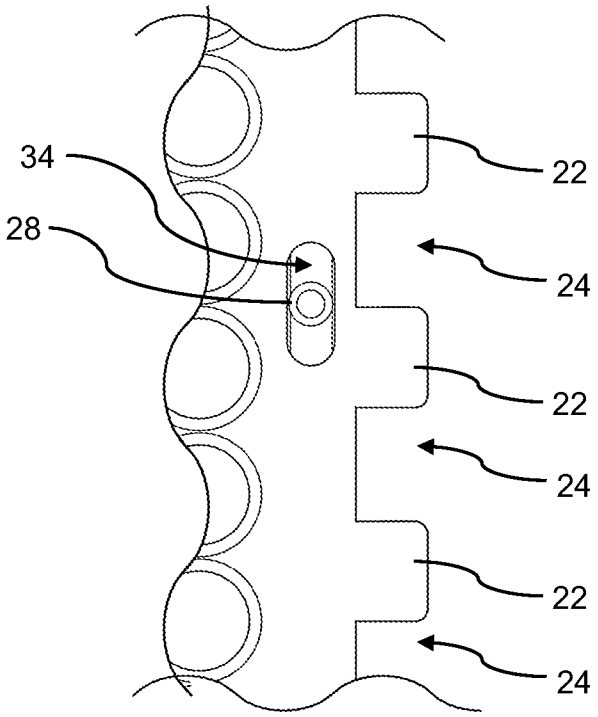

The actuation mechanism 26 comprises a bar 30 which is movably mounted along the width direction X of the coupling unit 14. The first locking elements 20 are fixedly connected to the bar 30 at different positions via coupling pins 32. The control element 28 comprises two hollow cylindrical projections protruding from opposite sides of the bar 30 along the thickness direction Z. The two hollow cylindrical projection are guided in a respective recess 34 on opposite faces of the side 12, as shown in FIG. 7, FIG. 8, and FIG. 9. By this arrangement, the hollow cylindrical projections are exposed so as to be accessible for an installer. The hollow cylindrical projections are designed such that the control element 28 can be operated manually by an installer and/or serves as a mechanical interface for a tool, for example a screwdriver.

The control element 28 may be moved gradually between three positions. More specifically, the control element 28 may be moved between two end positions and an intermediate position. In a first end position, as shown in FIG. 7, the hollow cylindrical projections of the control element 28 abut against an end portion of the recess 34 and the first locking elements 20 are arranged in the first locking position. In a second end position, as shown in FIG. 8, the hollow cylindrical projections of the control element 28 abut against an opposite end portion of the recess 34 and the first locking elements 20 are arranged in the second locking position. In the intermediate position, as shown in FIG. 9, the hollow cylindrical projections of the control element 28 are arranged between the first and the second end positions and the first locking elements 20 are positioned in the release position.

As shown in FIG. 4, FIG. 5, and FIG. 6, the actuation mechanism 26 further comprises a resistance unit 36 configured to set a minimum actuation force of the control element 28. In doing so, unintentional actuation, for example induced by weight force acting on the actuation mechanism 26, may be prevented. Specifically, the resistance unit 36 is configured to set a minimum actuation force of the control element 28 depending on a position of the first locking elements 20 relative to the second locking elements 22. By this configuration, a gradual actuation of the control element 28 may be provided. For doing so, the resistance unit 36 comprises a guide pin 38 and a spring element 40 abutting thereon. The guide pin 38 is fixedly connected to a sidewall of the side 12, and the spring element 40 is fixedly connected to the bar 30. In the shown configuration, the spring element 40 pushes against the guide pin 38 and is elastically deformed when the control element 28 is actuated. Further, when actuating the control element 28, the guide pin 38 and the spring element 40 are moved relative to one another. Accordingly, by this configuration, the control element 28 is subjected to forces, in particular resilient and frictional forces. For allowing gradual or stepwise actuation, the spring element 40 is provided with predefined notches, in particular three notches spaced apart from each other. Each one of the notches is associated to one of the following positions of the first locking elements 20: the first locking position, the second locking position and the release position. Positioning the guide pin 38 in a notch of the spring element 40 causes that, in this state, a mechanical resistance required when actuating the control element and accordingly the minimum actuation force are increased. In other words, in a state of the actuation mechanism 26 in which the guide pin 38 is arranged in a notch of the spring element 40, a higher actuation force is required to actuate the control element 28 compared to a state of the actuation mechanism 26 in which the guide pin 38 is not arranged between notches.

By this configuration, the resistance unit 36 is designed such that, in a state in which the first locking elements 20 are disposed relative to the second locking elements 22 in any one of the first locking position, the second locking position and the release position, the minimum actuation force of the control element 28 is greater compared to states in which the first locking elements 20 are disposed relative to the second locking elements 22 between the first locking position and the release position or between the second locking position and the release position.

In some embodiments, the coupling unit 14 or the structural component 10 may comprise a blocking mechanism or blocking unit configured to block displacement of the first locking elements 20 relative to the second locking elements 22. For doing so, the blocking unit may fix a position of the control element 28. For example, the blocking unit may be provided in the form of a closure cap that is form-fittingly connectable to the recess 34 and the hollow cylindrical projection disposed therein to fix the hollow cylindrical projection and thus the control element 28 relative to the recess 34. In some embodiments, the blocking unit may be configured to create a releasable form-fit or force-fit connection with the bar 30 so as to fix the first locking elements 20 relative to the second locking elements 22. The blocking unit may further comprise a lock device to prevent unauthorized or unintended actuating of the control element 28. For example, the lock device may be configured to allow an actuation of the blocking unit using a mechanical or electronic key, whereas an actuating without a key is locked.

As set forth above, the structural component 10 is intended to be structurally coupled to component of the modular system which may have an identical or different design. In the following, with reference to FIG. 10, FIG. 11, FIG. 12, FIG. 13, and FIG. 14, a method for coupling the structural component 10 to a further structural component 10' of an identical design in a form-fitting manner. Hereinafter, reference signs provided with an apostrophe refer to elements of the further structural component 10'.

Figure 10:
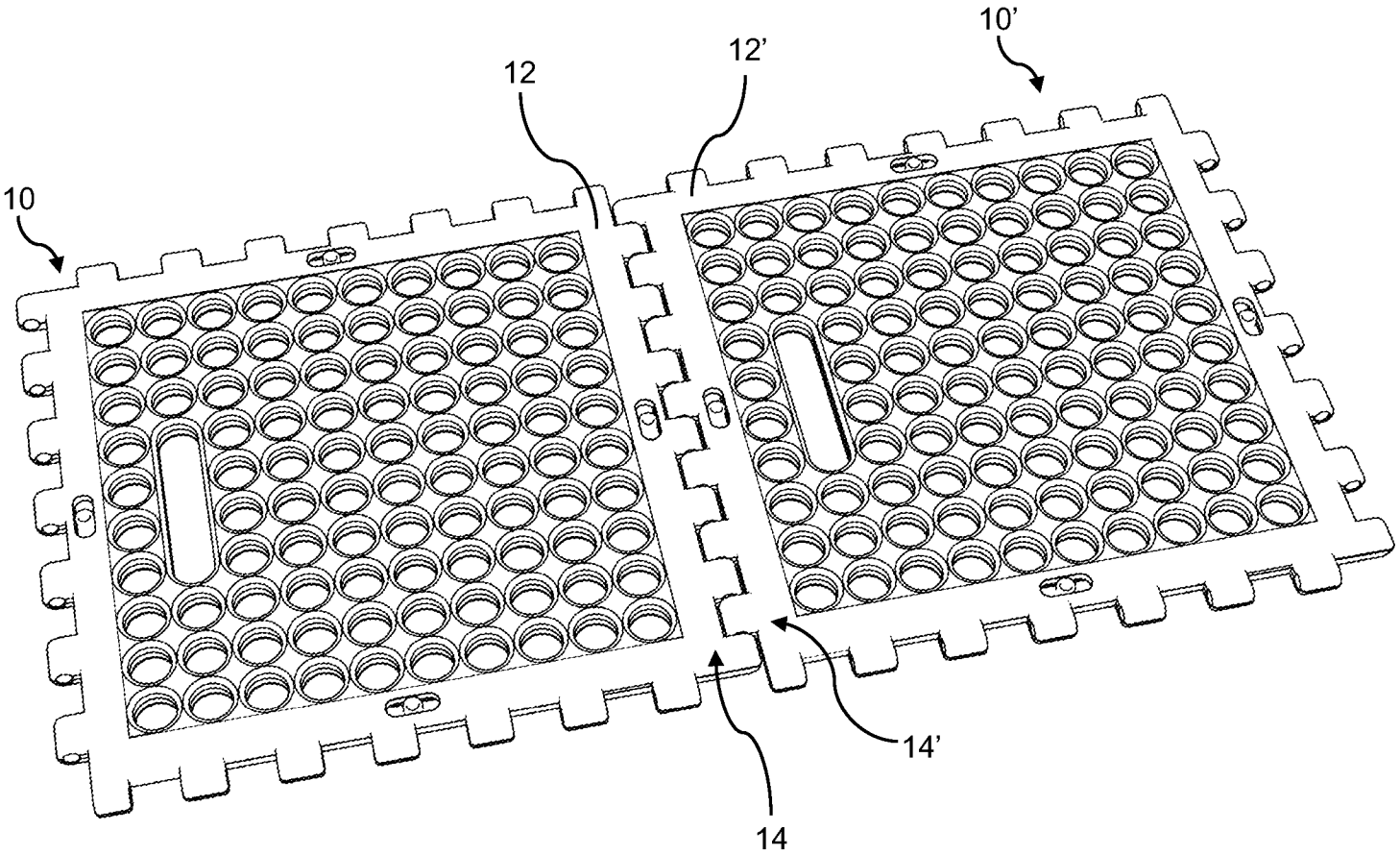
FIG. 10 is a perspective view of an assembly unit according to an embodiment comprising two structural components in an engaged state.
Figure 11:
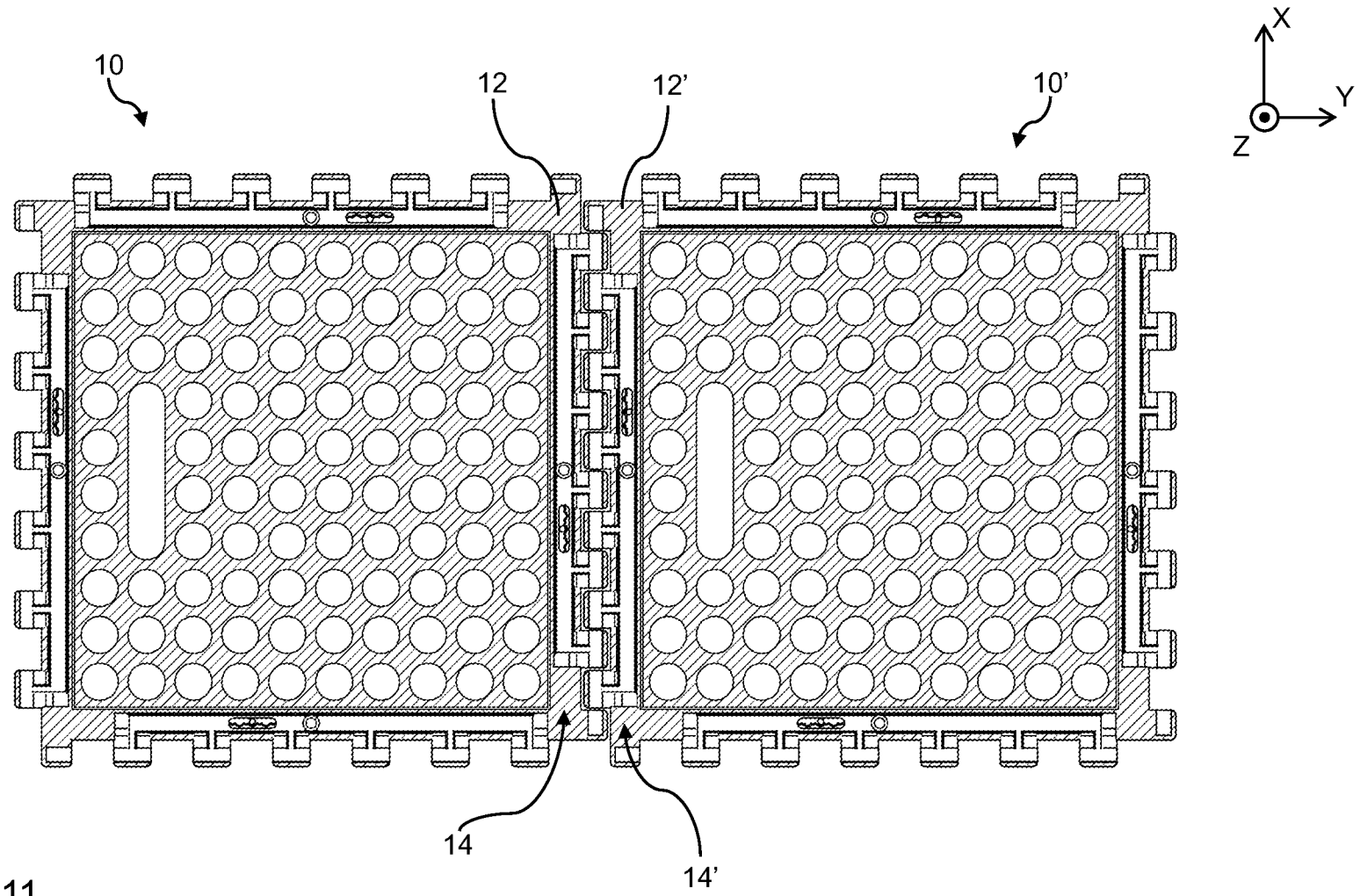
FIG. 11 is a perspective view of a longitudinal section of the assembly unit shown in FIG. 10.
Figure 12:
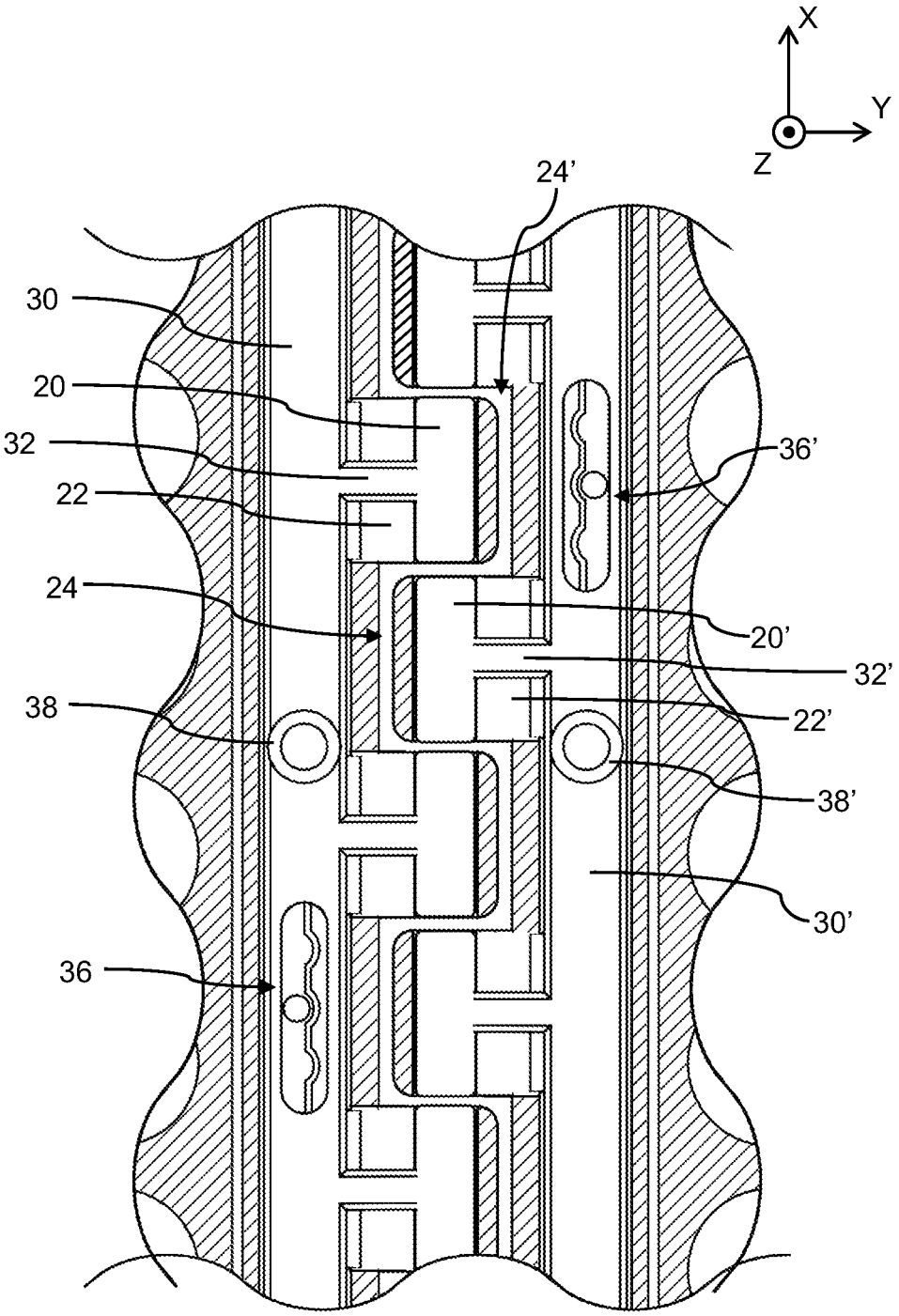
FIG. 12, FIG. 13, and FIG. 14 are enlarged views of a longitudinal section of coupled coupling units of the assembly unit in different states.

At first, the structural component 10 and the further structural component 10' are provided. The coupling units 14, 14', which are to be coupled to one another, are each set in the release position, i.e. the first locking elements 20, 20' of the coupling unit 14 and the further coupling unit 14' are arranged in the release position. Thereafter, the coupling units 14, 14' to be coupled are positioned into the engagement state, as shown in FIG. 10, FIG. 11, and FIG. 12. In the engagement state, the second locking elements 22, 22' of one coupling unit 14, 14' are respectively arranged in the receiving spaces 24', 24 of the other coupling unit 14', 14, and vice versa, as can be gathered from FIG. 12.

Starting from the engagement state, the coupling units 14, 14' to be coupled may each be brought into the locking state by adjusting the locking elements 20, 22, 20', 22' to either the first or the second locking position. The coupling units 14, 14' are designed such that, by displacing the locking elements 20, 22 of the coupling unit 14 relative to each other into their first or second locking position, the locking elements 20', 22' of the further coupling unit 14' are caused to be displaced relative to one another into their second or first locking position. In other words, in the engagement state of the coupling unit 14 and the further coupling unit 14', displacing the position of the first and the second locking elements 20, 22 of the coupling unit 14 relative to one another causes the further locking elements 20', 22' of the further coupling unit 14' to be displaced relative to one another. This is achieved by having the first locking elements 20 of the coupling unit 14 pressing against the further first locking elements 20' of the further coupling unit 14'. Thus, upon displacing the control element 28, the coupling unit 14, i.e. its locking elements 20, 22, are brought into the first locking position and the further coupling unit 14', i.e. its locking elements 20', 22', are brought into the second locking position, as shown in FIG. 13, or vice versa, as shown in FIG. 14.

Figure 13:
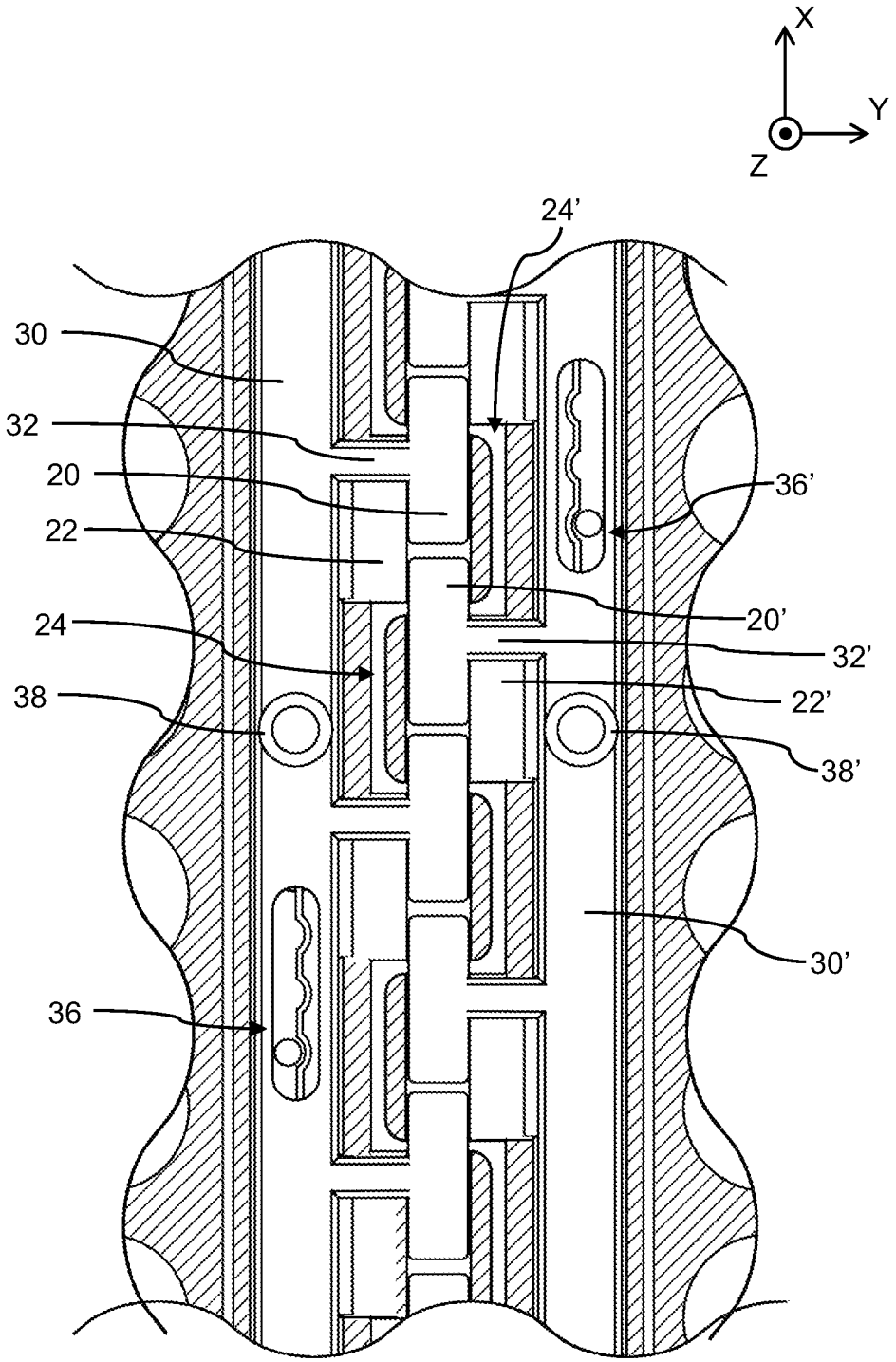
Figure 14:
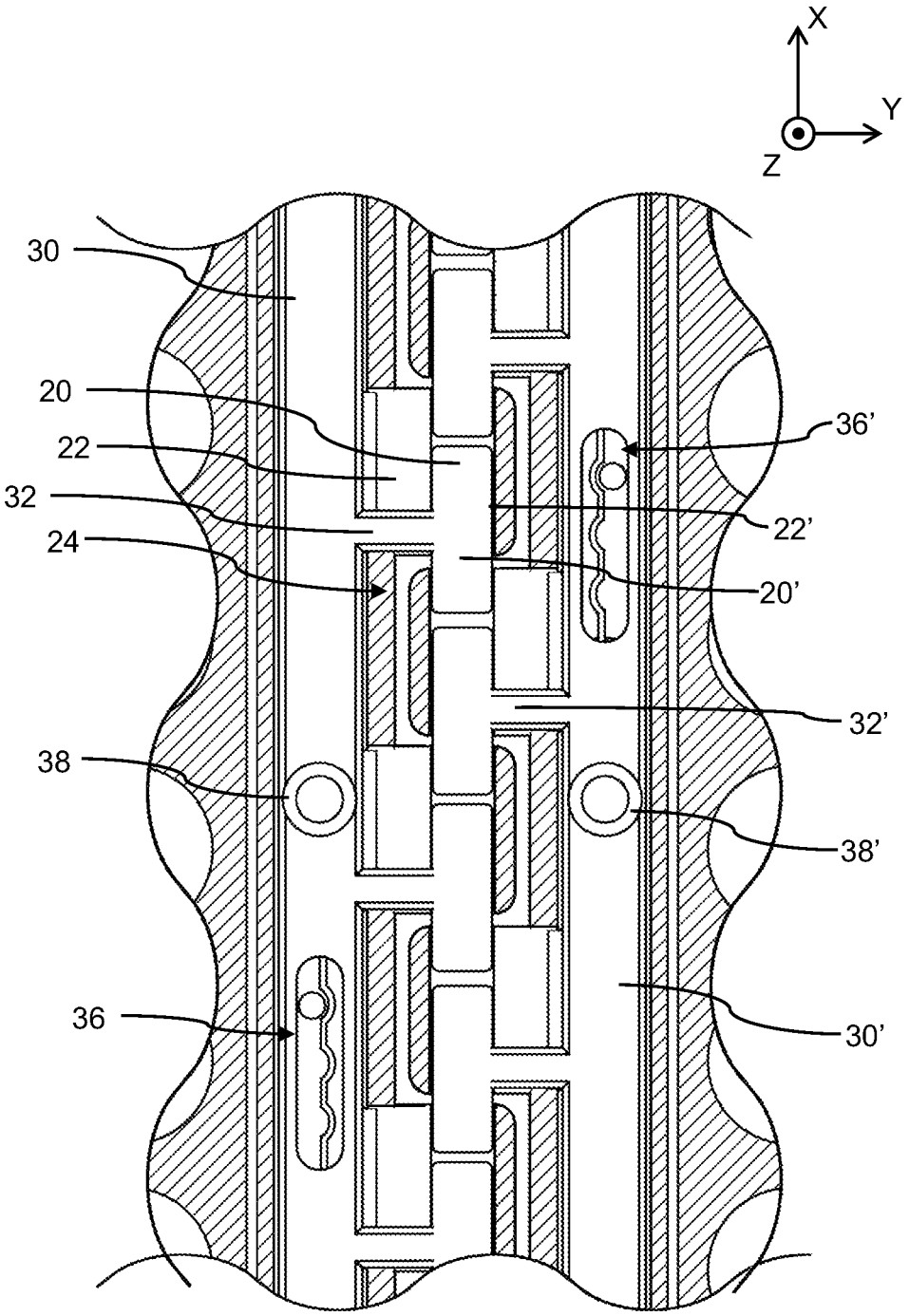

Each one of FIG. 13 and FIG. 14 shows the locked state of the structural component 10 and the further structural component 10'. The coupling units 14, 14' are designed such that, in the locked state, a rotational degree of freedom between the components is released about an axis S, also referred to as a pivot axis, which is arranged parallel to the width direction X of the coupling units 14, 14'. In other words, in the locked state, the structural component 10 and the further structural component 10' are pivotable relative to each other about an axis aligned with the longitudinal axis of the first locking elements 20, 20'. In some embodiments, the coupling units 14, 14' are designed such that, in the locked state, the additional rotational degrees of freedom, i.e. about an axis parallel to the front end direction Y and the thickness direction Z of the coupling units 14, 14', are locked. In the locked state, the translational degrees of freedom along the width direction X, front end direction Y and thickness direction Z of the coupling units 14, 14' are further locked. In other words, in the locked state, the coupling units 14, 14' form a joint unit that, in particular, forms a radial bearing about an axis parallel to the width direction X and an axial bearing along this axis. In the locked state, the structural component 10 and the further structural component 10' are pivotable about the pivot axis S by 240° relative to each other. In other words, in order to pivot the structural component 10 from a first pivot end position to a second pivot end position relative to the further structural component 10', the structural component 10 may be pivoted by 240° about the pivot axis S relative to the further structural component 10'. For enabling such pivot movements, the coupling units 14, 14' may be designed as shown in FIG. 15.

Figure 15:
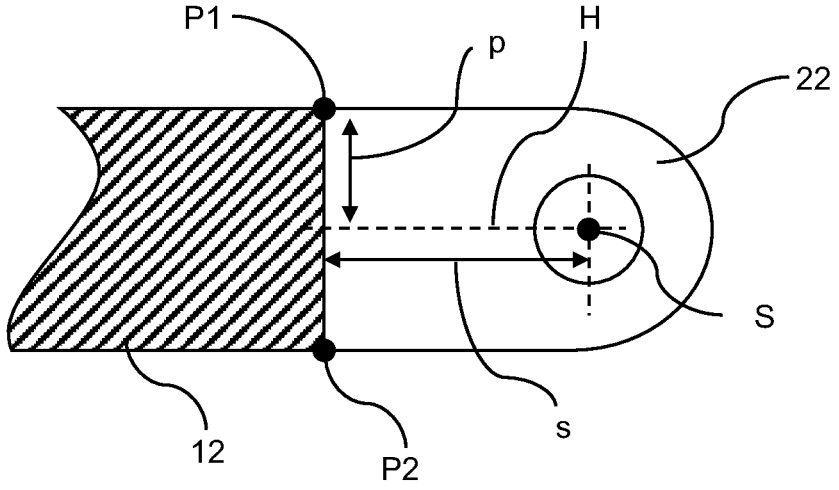
FIG. 15 is a sectional view of a side of the structural component.

FIG. 15 shows a cross-sectional view of the side 12 facing a second locking element 22. In the shown configuration, point P1 and point P2 indicate points of contact at which a further structural component 10' coupled to the structural component 10 rests, in particular with its second locking element 22', in the first pivot end position and the second pivot end position. In order to enable a desired maximum pivoting angle between two structural components 10, 10' engaged in the locked state, the structural arrangements of the contact points P1, P2 and the pivot axis S relative to each may be relevant. A distance between the pivot axis S and a line connecting the contact points P1 and P2 is referred to herein as "s" and is 10 mm in the shown configuration. In FIG. 15, an auxiliary line H, i.e. an imaginary line, is drawn which runs normal to the line connecting the contact points P1 and P2 and crosses the swivel axis S. A distance between the auxiliary line H and the contact points is referred to herein as "p" and is 8 mm in the shown configuration. In other words, a quotient of p by s is 0.8 in the shown configuration. In some embodiments of the structural component, the quotient may have a value of substantially 0.7 or 0.8 or 0.9 or 1 or a value between 0.6 and 1.2.

Figure 16:
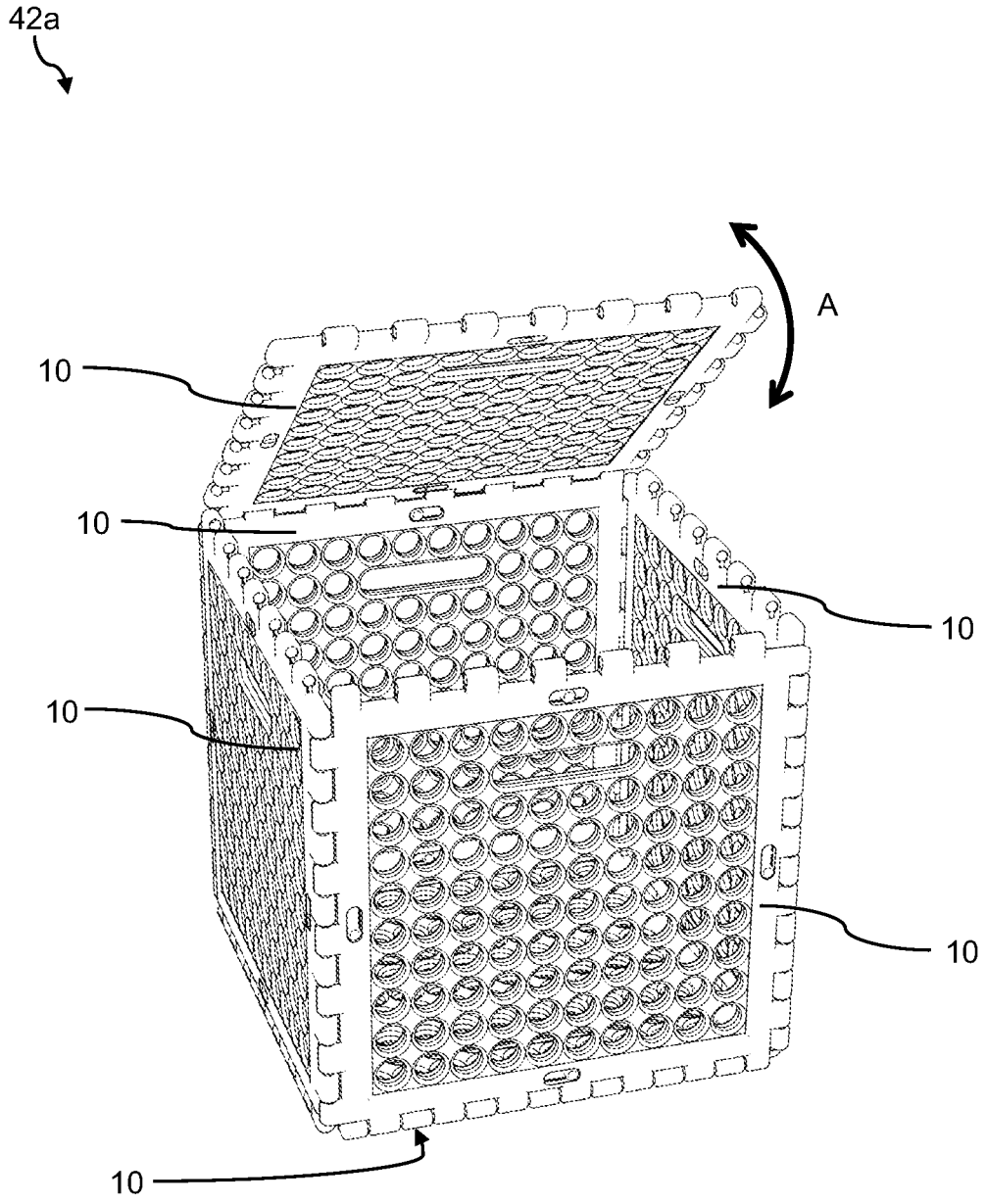
FIG. 16 and FIG. 17 are perspective views of a further assembly unit in different states.
Figure 17:
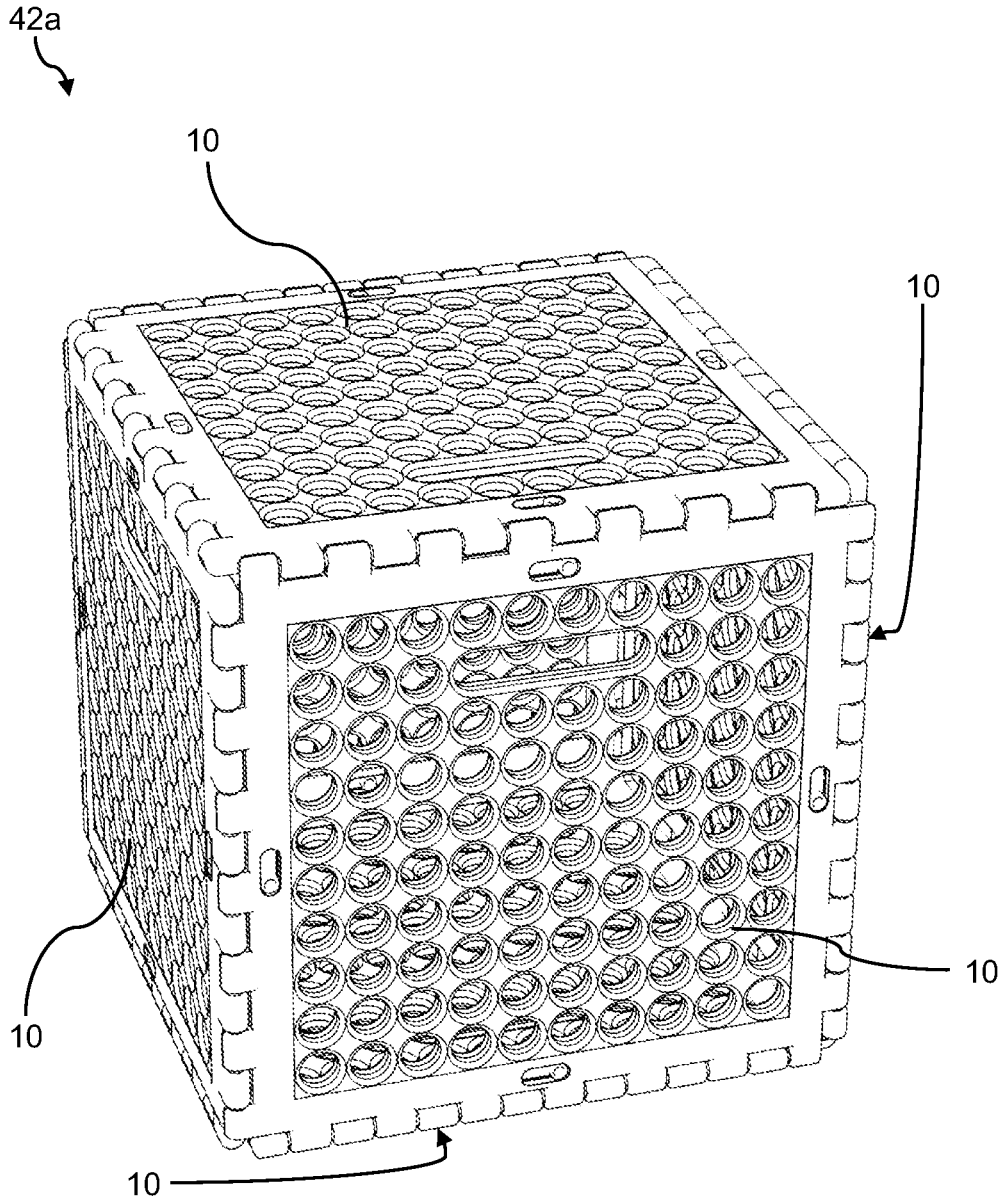

FIG. 16 and FIG. 17 show an assembly unit 42*a* provided in the form of a box or crate, which in particular is intended for use in storage systems or bundling systems or transportation systems or structural installations. The assembly unit 42*a* comprises six structurally identical structural components 10, which are form-fittingly connected to one another via their sides 12, in particular via their coupling units 14. As such, the interlocked coupling units 14 are in the locked state. Accordingly, the structural components 10 forming the side walls of the box are interlocked at their side 12 facing the bottom with the structural component 10 forming the bottom. In some embodiments, the lateral sides 12, i.e. facing in a circumferential direction, of the structural components 10 forming the side walls are interlocked with the structural components 10 adjacent thereto. A structural component 10 forming the lid of the box is interlocked only at one side 12 with one of the structural components 10 forming a side wall. By this configuration, the box is provided with a hinged lid, as indicated by arrow A in FIG. 16. To lock the lid in a closed position, as shown in FIG. 17, a further coupling unit 14 of the structural component forming the lid may be locked to one further structural component 10 forming a side wall. From the position shown in FIG. 17, the lid is pivotable by 210° to attain a pivot end position in which the lid is opened.

Figure 18:
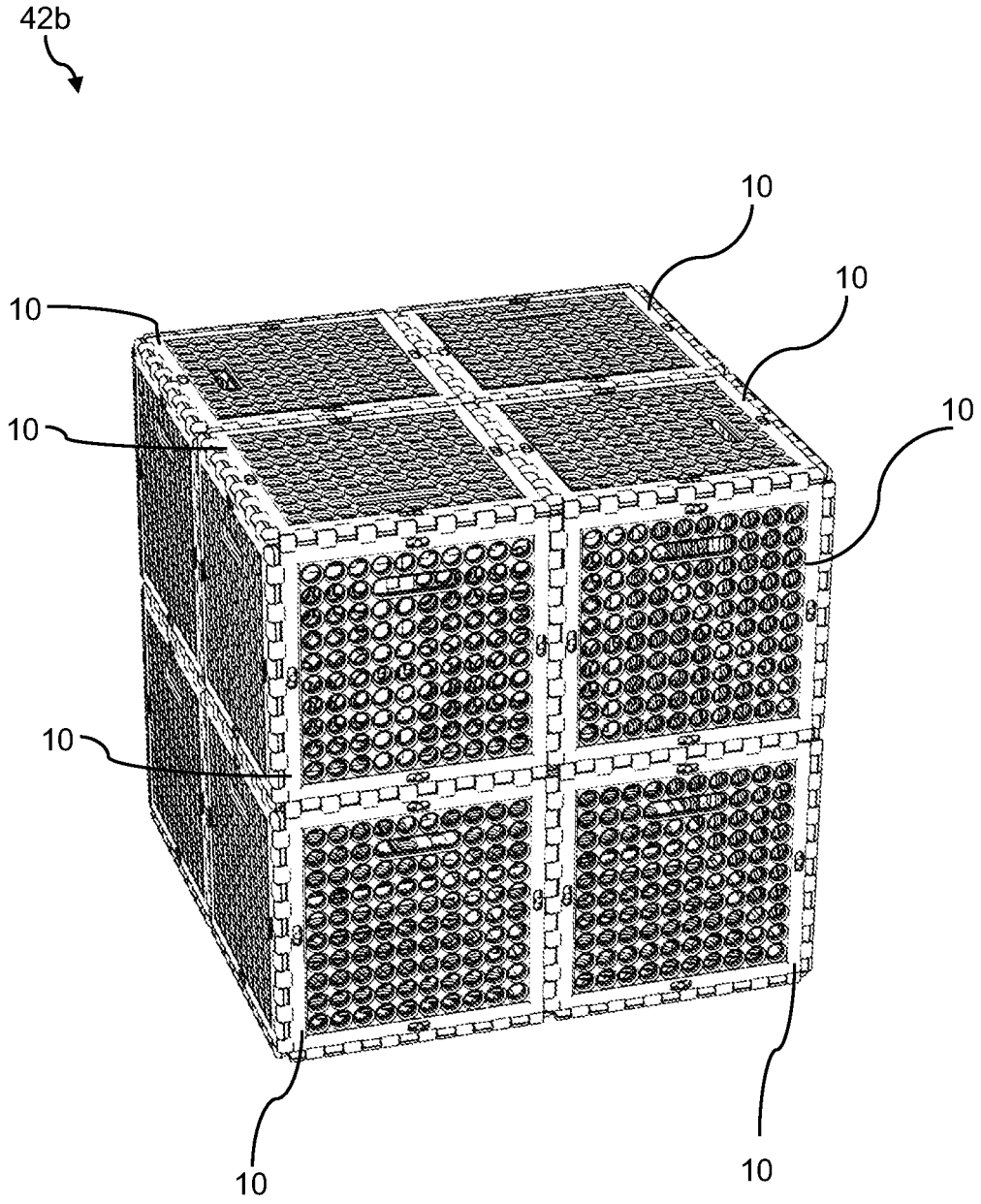
FIG. 18, FIG. 19, and FIG. 20 are perspective views of a further assembly unit in different states.
Figure 19:
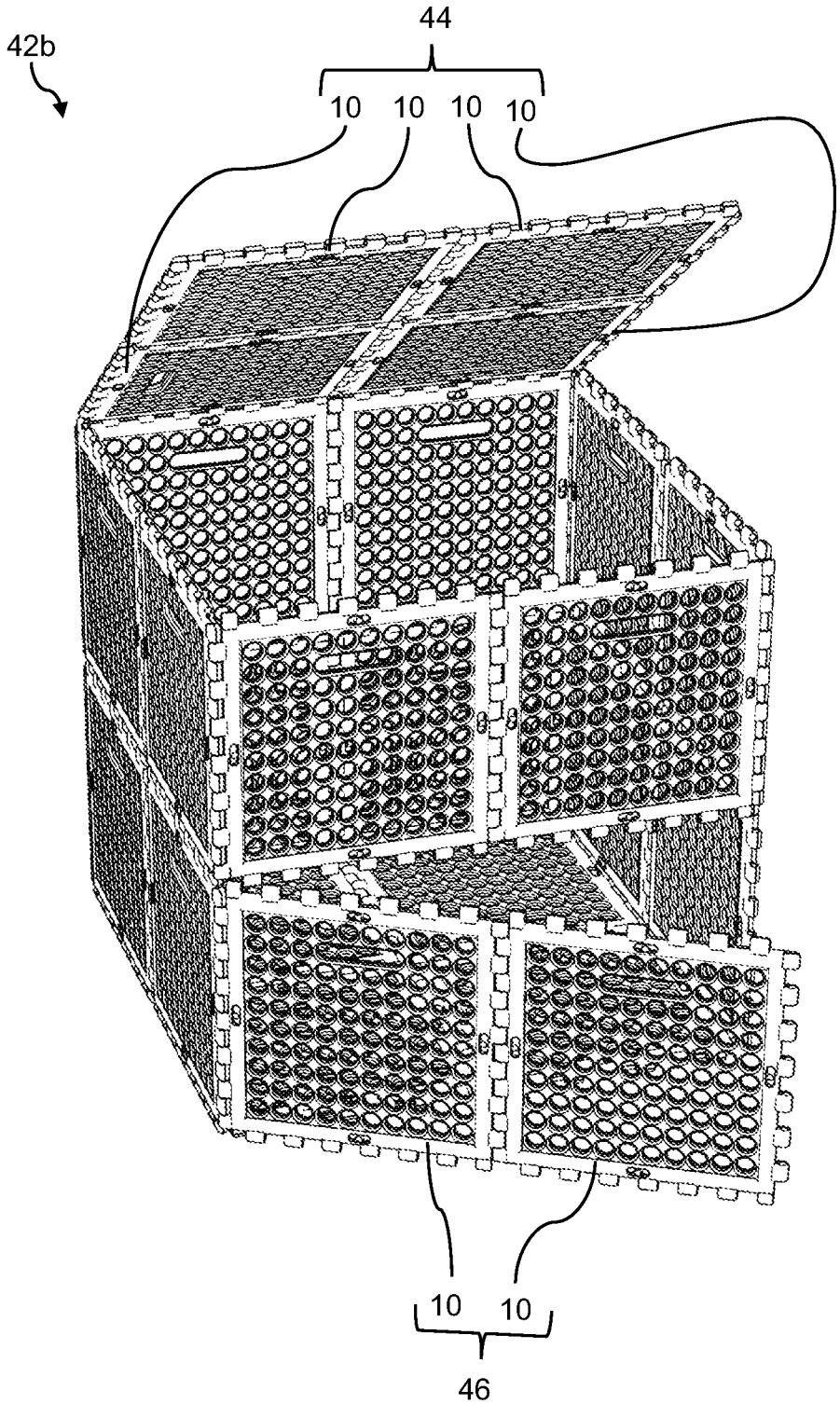
Figure 20:
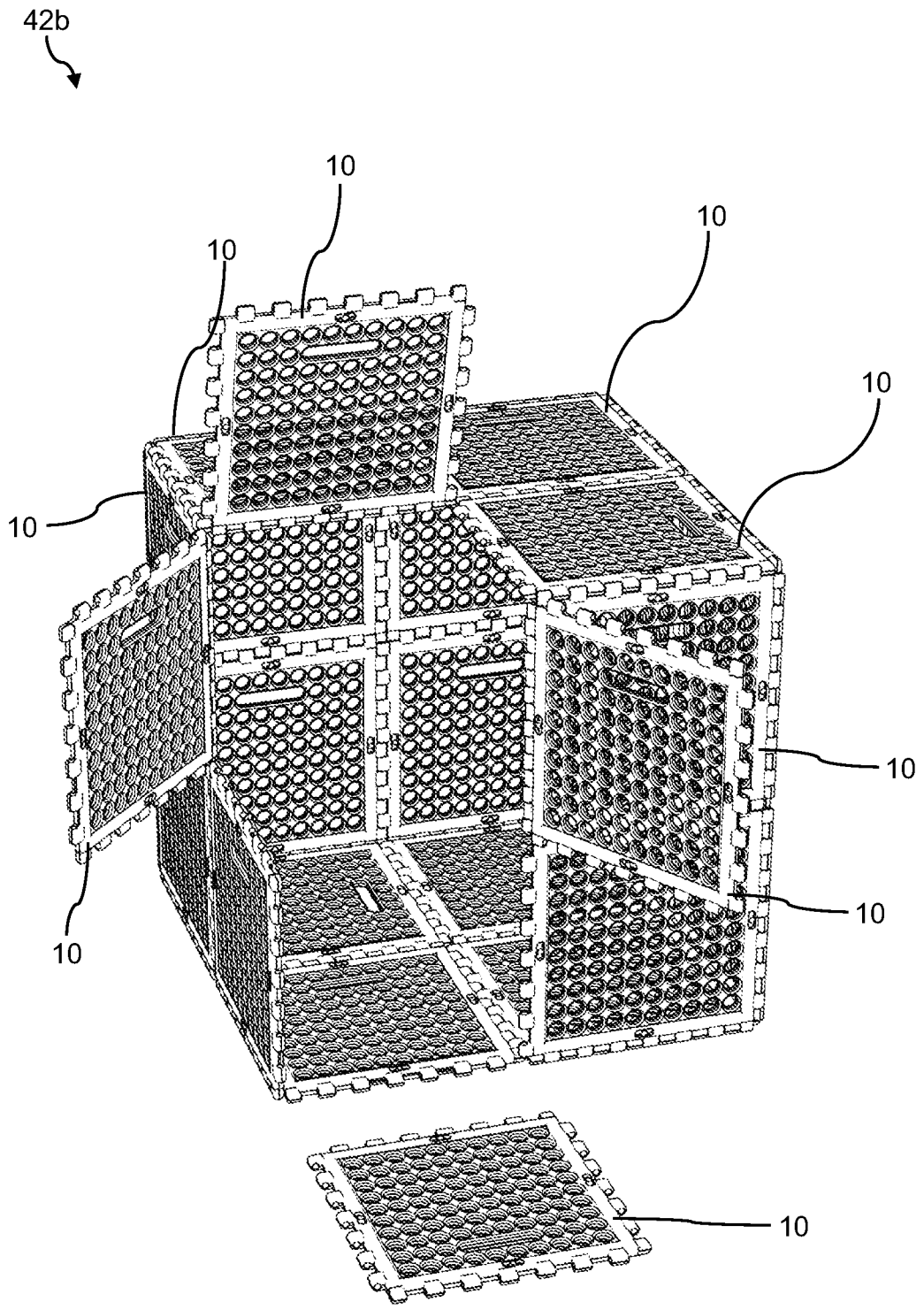

FIG. 18, FIG. 19, and FIG. 20 show a further assembly unit 42*b* in the form of a box or crate. In this embodiment, each one of the lid, the bottom and the side walls is formed by four structural components 10 connected together in a plane. In the state shown in FIG. 18, all coupling units 14 are in the locked state. FIG. 19 shows the assembly unit 42*b* in a further state in which the locked state of individual coupling units 14 is selectively released to provide a hinged lid 44 and a hinged side panel door 46 formed by two structural components 10. In addition, individual structural components 10 may be selectively decoupled from the assembly unit 42*b*, as shown in FIG. 20. Accordingly, the proposed configuration allows that the interior of the assembly unit 42*b* is accessible via different openings. Each of the structural components 10 employed in the assembly unit 42*b* can thus be selectively opened and closed, either individually or together with other components.

Figure 21:
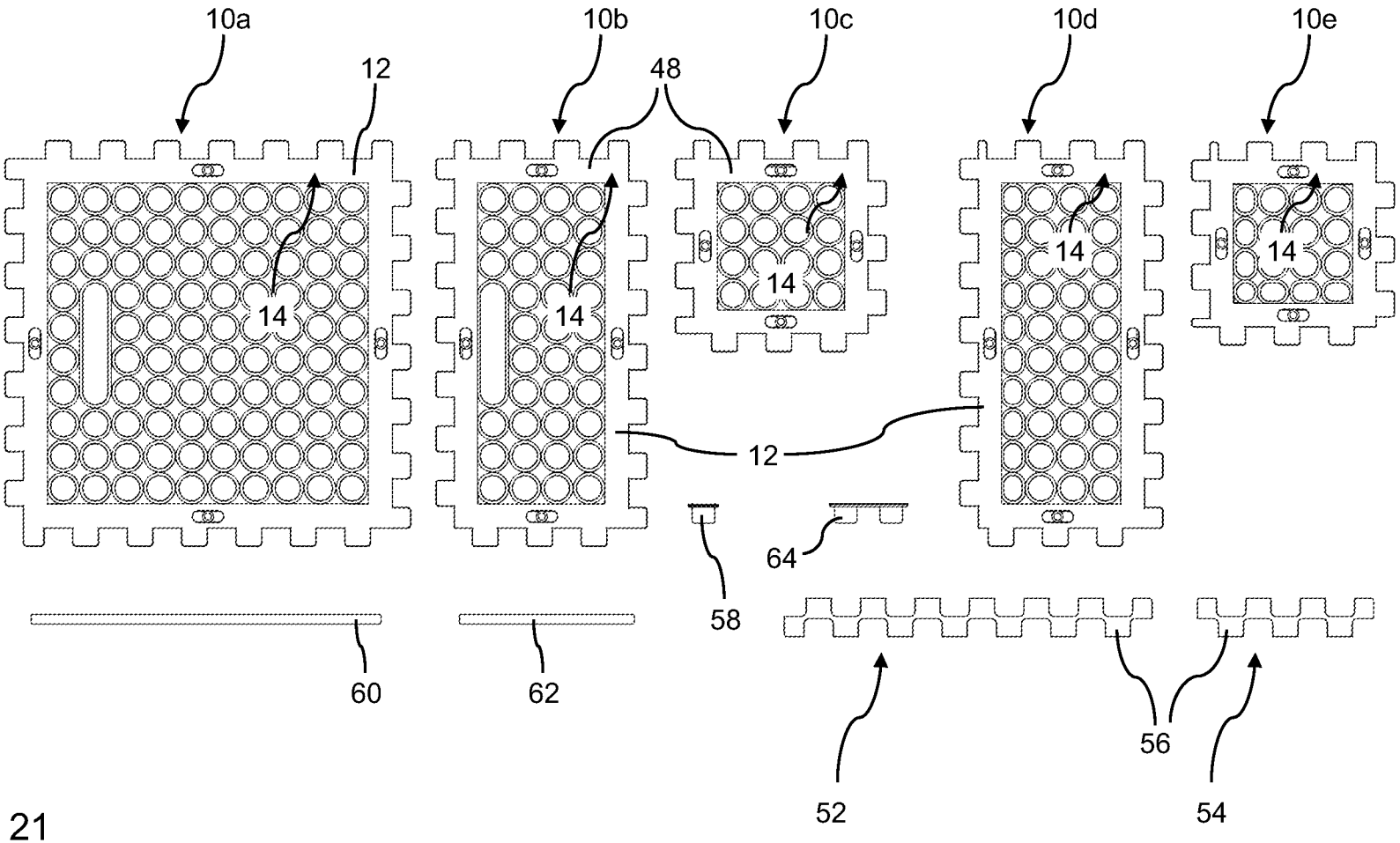
FIG. 21 depicts different components of a modular system.

FIG. 21 shows different interconnectable components of the modular system. The modular system comprises a plurality of plate-shaped structural components 10*a*-10*e*, which differ with regard to their length and/or width. The first structural component designated by reference sign "10*a*" corresponds to the above-described structural component 10. The different structural components 10*a*-10*e* have the same thickness. A second structural component 10*b* has a width which is half the width of the first structural component 10*a*. Accordingly, the second structural component 10*b* comprises two sides 12 with six first and the second locking elements 20, 22 and two shorter sides 48 with three or two first and three or two second locking elements 20, 22. One side 12 of the first structural component 10*a* may be coupled and locked to two second structural components 10*b* arranged side by side. A third structural component 10*c* has a width and a length which are half the width and length of the first structural component 10*a*. Accordingly, the third structural component 10*c* comprises four shorter sides 48 each having two or three first and two or three second locking elements 20, 22.

A fourth structural component 10*d* has a width which is smaller than the width of the second structural component 10*b*, in particular a width smaller by at least the thickness of the structural components 10*a*-10*e*. By this configuration, it is enabled that one side 12 of the first structural component 10*a* can be coupled and locked to two fourth structural components 10*d* which are arranged next to one another in a plane, wherein the two fourth structural components 10*d* are not interconnected via their longer sides 12. A fifth structural component 10*e* has a width and a length which are smaller than the width and length of the third structural component 10*c*, specifically a width and length smaller by at least the thickness of the structural components 10*a*-10*e*.

Based on the shown modular system, a large number of different assemblies or objects can be built using the five different structural components 10*a*-*e*.

Figure 22:
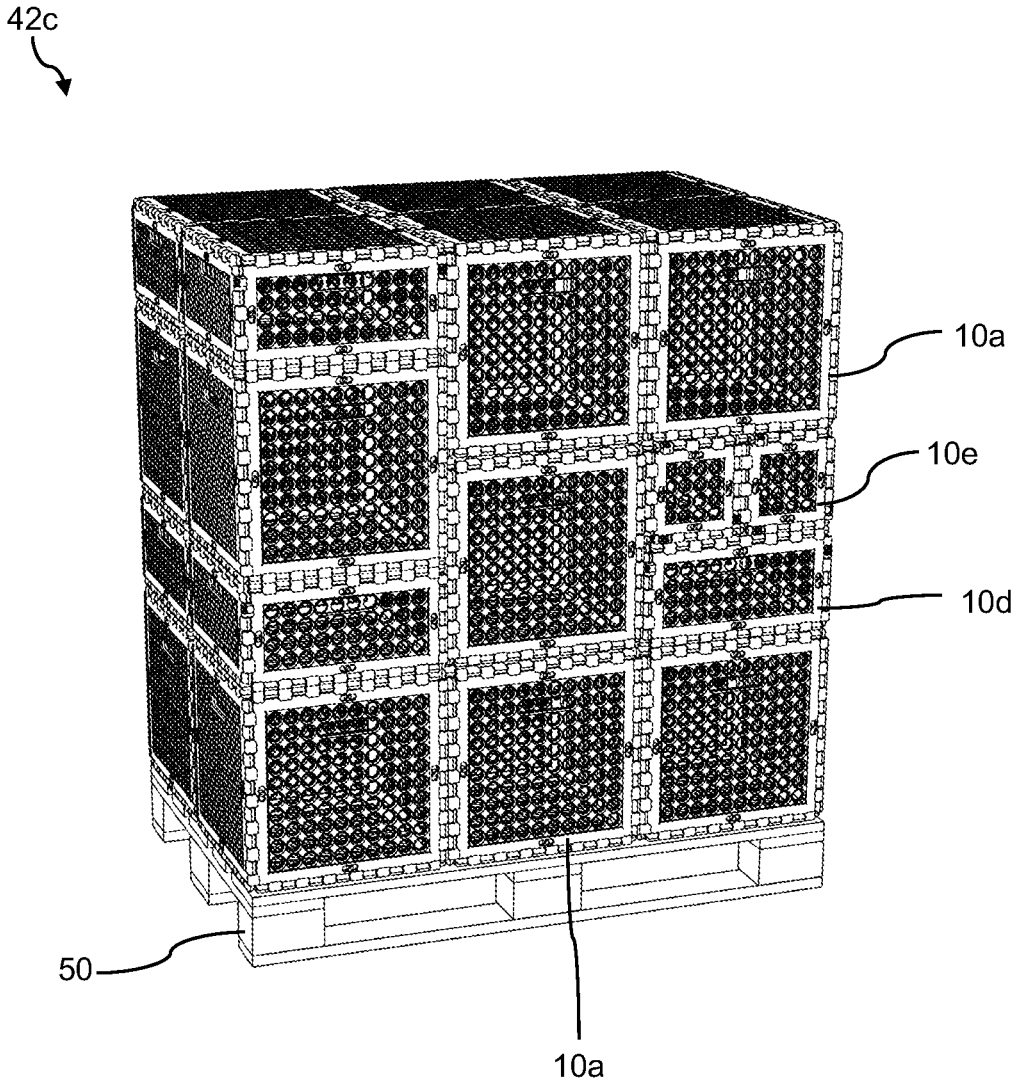
FIG. 22, FIG. 23, and FIG. 24 are perspective views of a further assembly unit in different states.
Figure 23:
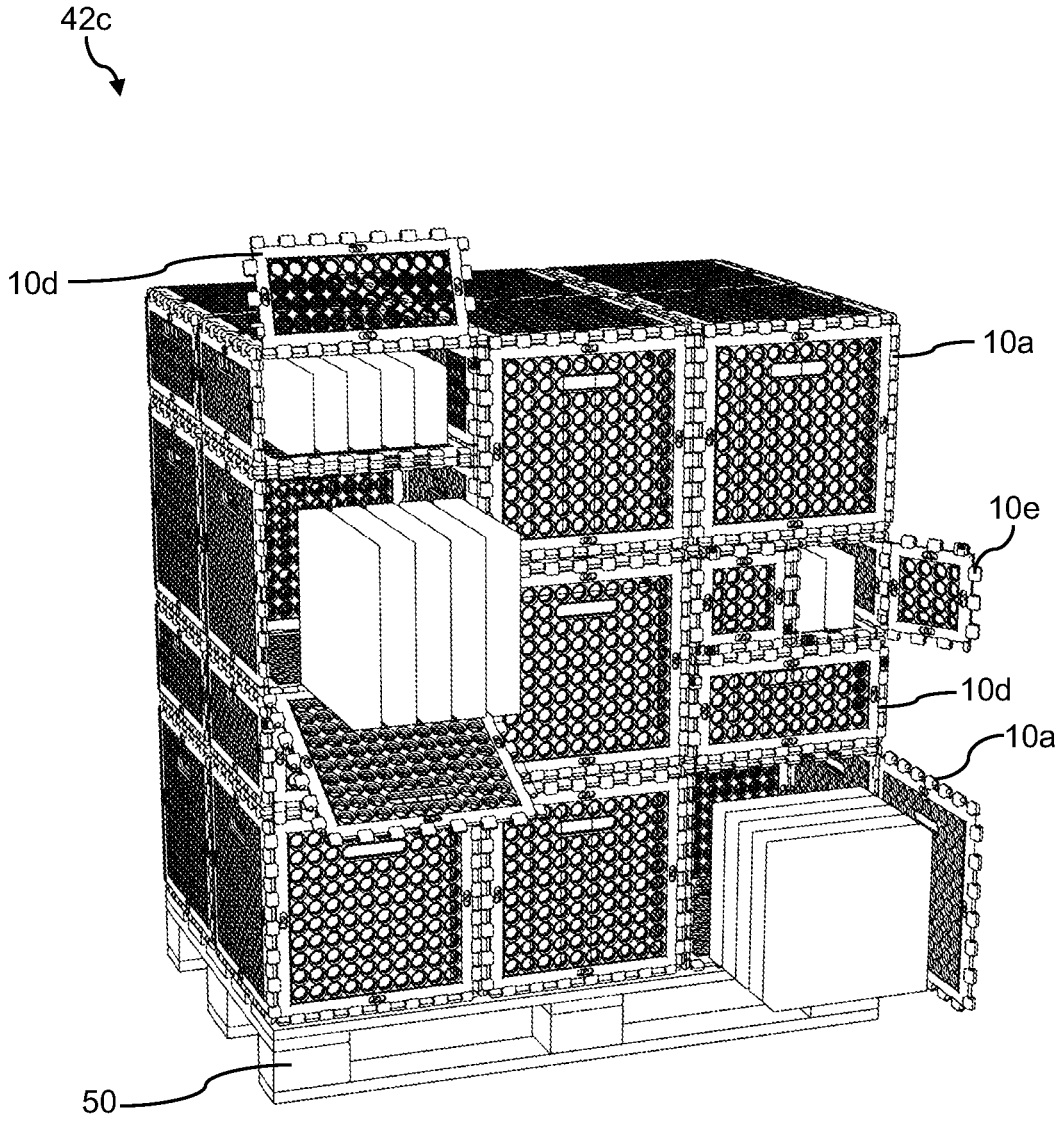
Figure 24:
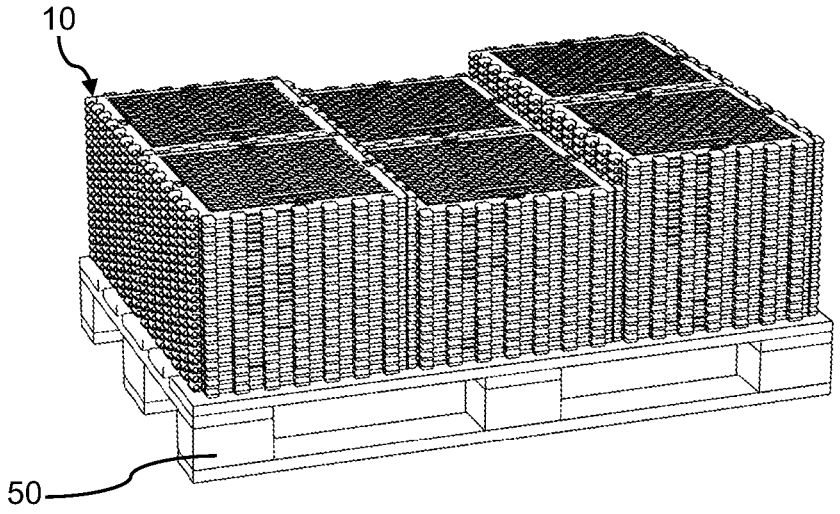

FIG. 22 shows a further assembly unit 42*c* in the form of a box or crate built by the different components of the modular system, in particular built by employing the first, fourth and fifth structural components 10*a*, 10*d* and 10*e*. The assembly unit 42 is received on a euro pallet 50 such that it is flush therewith. By this configuration, an installer may easily open individual sections of the crate, as shown in FIG. 23, to provide easy access to goods received therein. The assembly unit 42*c* may thus be provided in the manner of a shelf with lockable compartments or openings. After their intended use, the structural components 10*a*-10*e* can be easily disassembled and stored on the euro pallet 50. FIG. 24 exemplarily shows a plurality of structural components 10 which are stored in a disassembled state on the euro pallet 50. In order to prevent slippage in this stacked state, the structural components 10*a*-10*e* may be provided on their faces with coupling elements corresponding to each other, so that in the stacked state two structural components lying on top of each other are form-fittingly connected via these coupling elements, specifically along the longitudinal direction and along the width direction.

Figure 25:
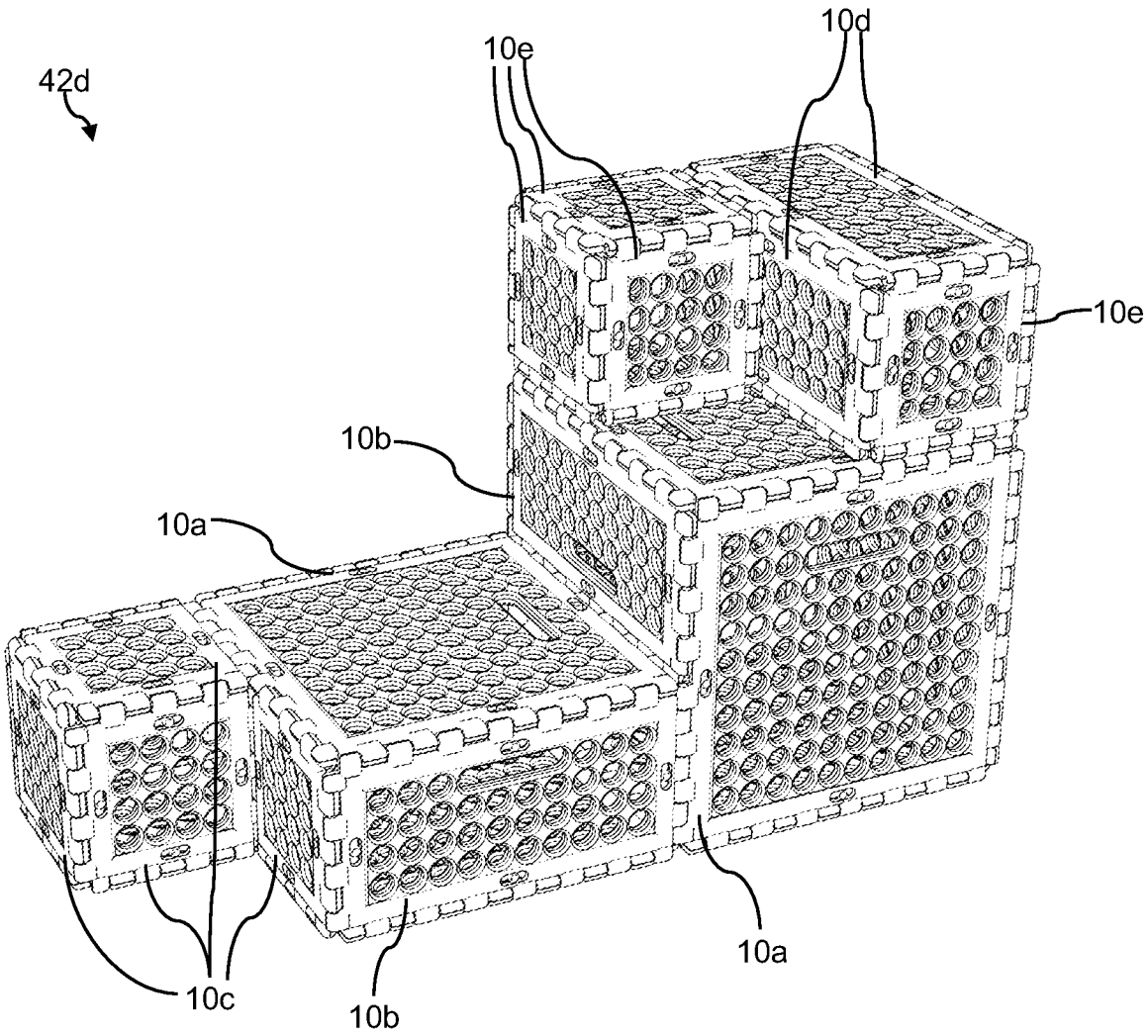
FIG. 25 is a perspective view of a further assembly unit.

In some embodiments, the modular system allows to easily create boxes or crates adapted to the shape of goods to be transported. This is exemplary shown in FIG. 25 which depicts a further assembly unit 42*d* built up from the structural components 10*a*-10*e*.

As shown in FIG. 21, the modular system further comprises a first folding connector 52 and a second folding connector 54. The folding connectors 52, 54 are configured to pivotably couple coupling units 14 of different or identical structural components 10*a*-10*e* such that they can be pivoted by 360° or substantially 360° relative to one another. The second hinge connector 54 is half as long as the first hinge connector 52.

The folding connectors 52, 54 comprise a first row of further locking elements 56 and a second row of further locking elements 56 arranged offset from the first row. The further locking elements 56 are formed by projections, each of which is provided with a through hole designed correspondingly to the first locking elements 20. As such, the further locking elements 56 are designed similar to the second locking elements 22.

Figure 26:
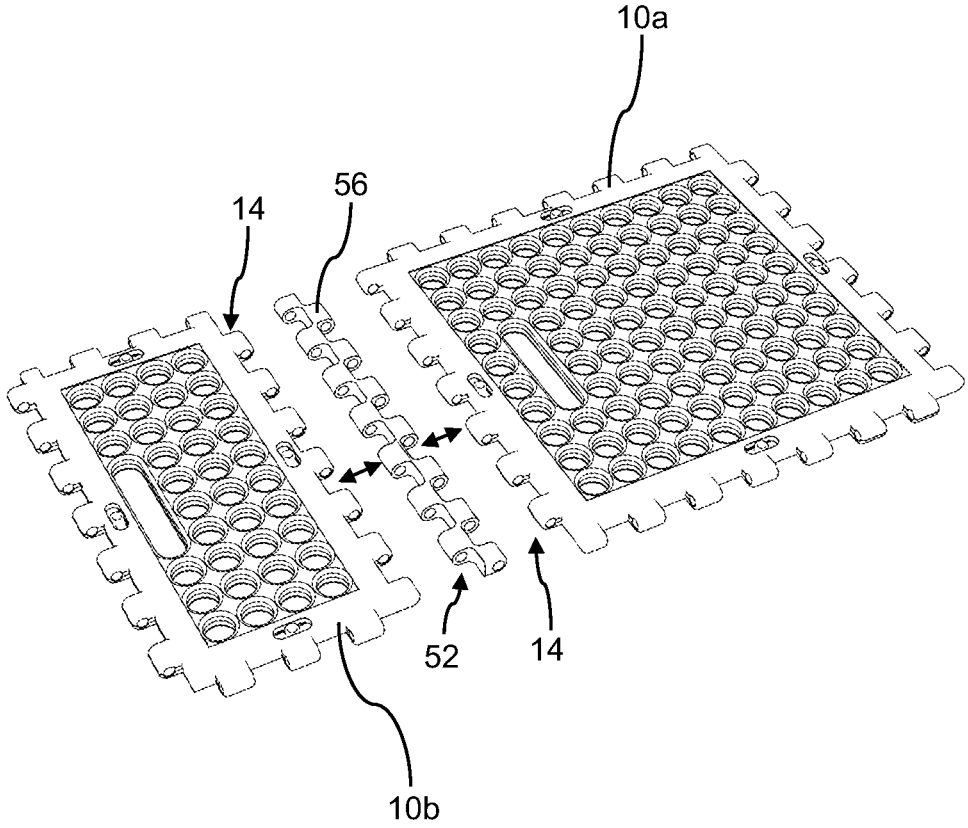
FIG. 26 is a perspective view of a further assembly unit in a disassembled state.

The first row of further locking elements 56 is configured to be form-fittingly connected to a coupling unit 14 of any first structural component of the modular system. The second row of locking elements 56 is configured to be form-fittingly connected to a coupling unit 14 of any second structural component of the modular system, as indicated by arrows in FIG. 26. The folding connectors 52, 54 are configured such that, in a coupled state in which a structural component 10*a*-10*e* is in the engagement state with the hinge connector 52, 54, the first locking elements 20 of the coupling unit 14 of the structural component can be form-fittingly coupled to the further locking elements 56 of the folding connectors 52, 54 by moving the first locking elements 20 into one of their locking position.

Figure 27A:
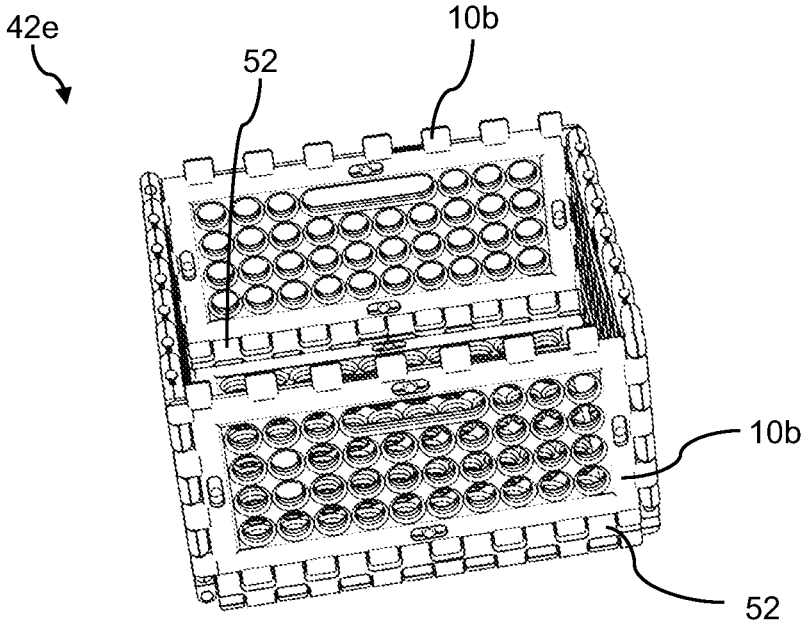
FIG. 27*a*, FIG. 27*b*, FIG. 27*c*, FIG. 27*d*, FIG. 27*e*, and FIG. 27*f* are perspective views of a further assembly unit in different states.
Figure 27B:
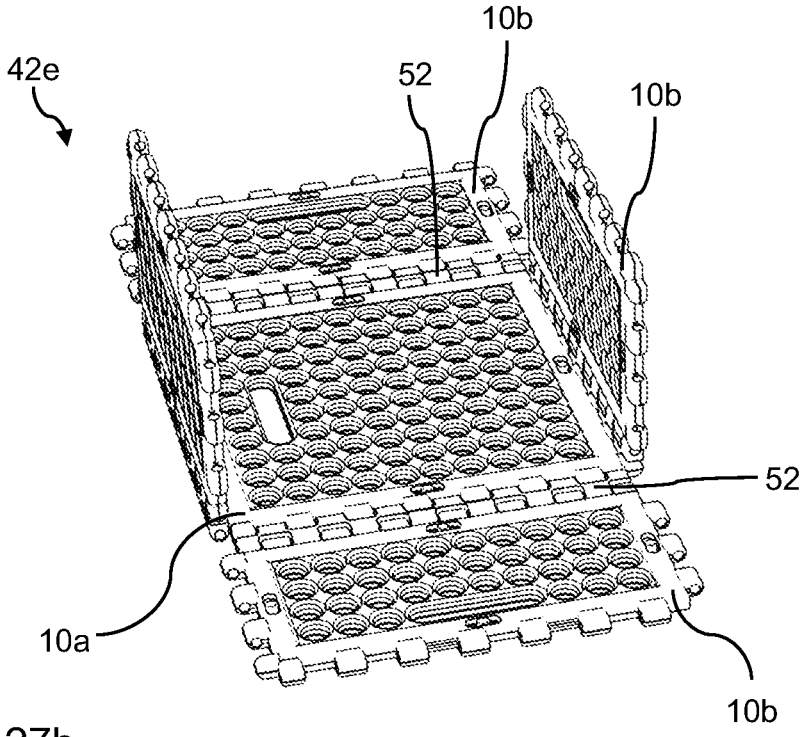
Figure 27C:
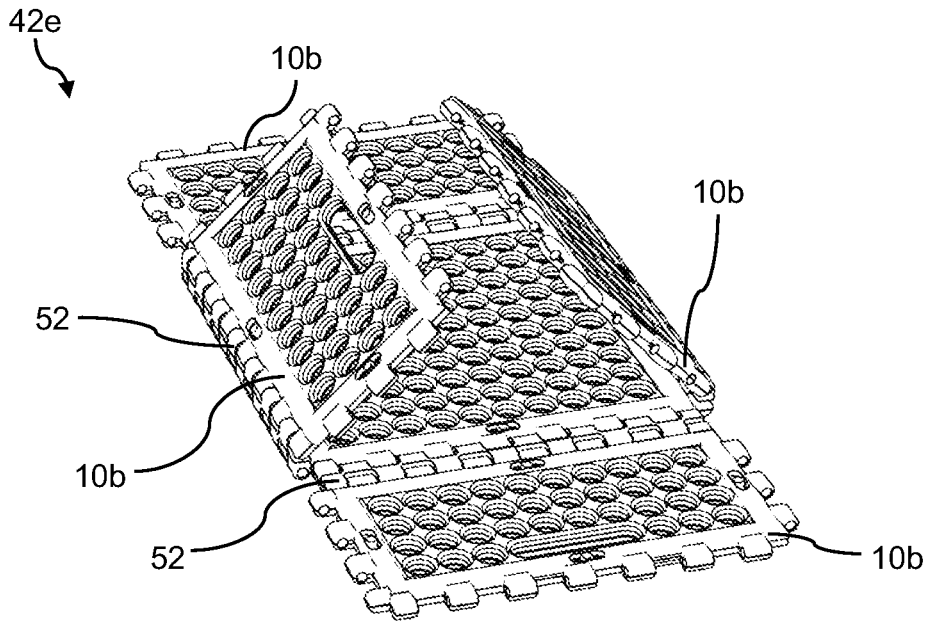
Figure 27D:
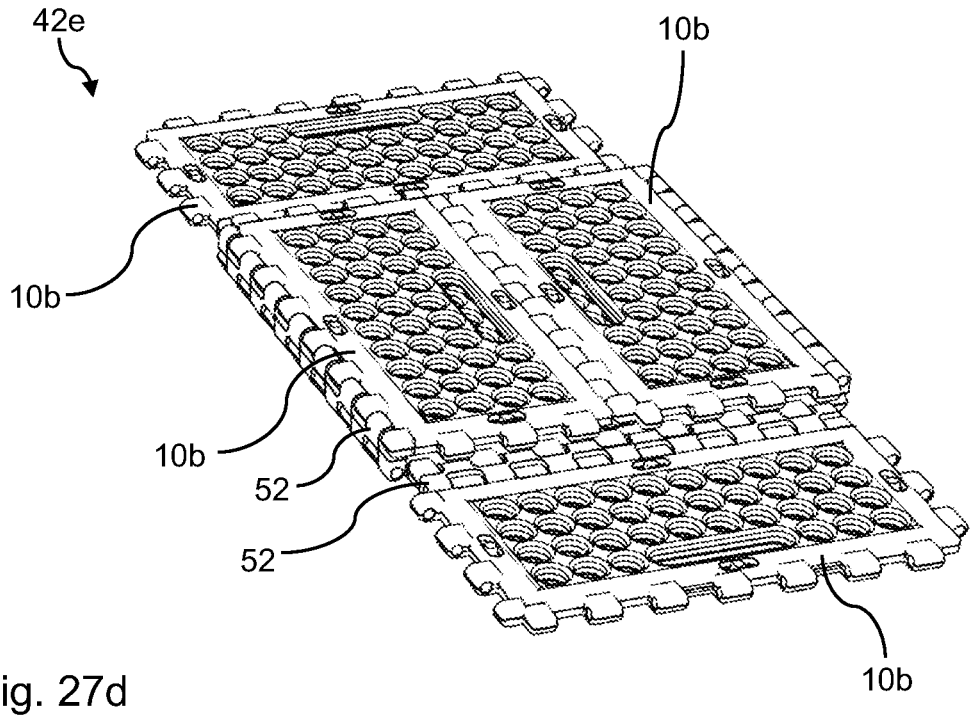
Figure 27E:
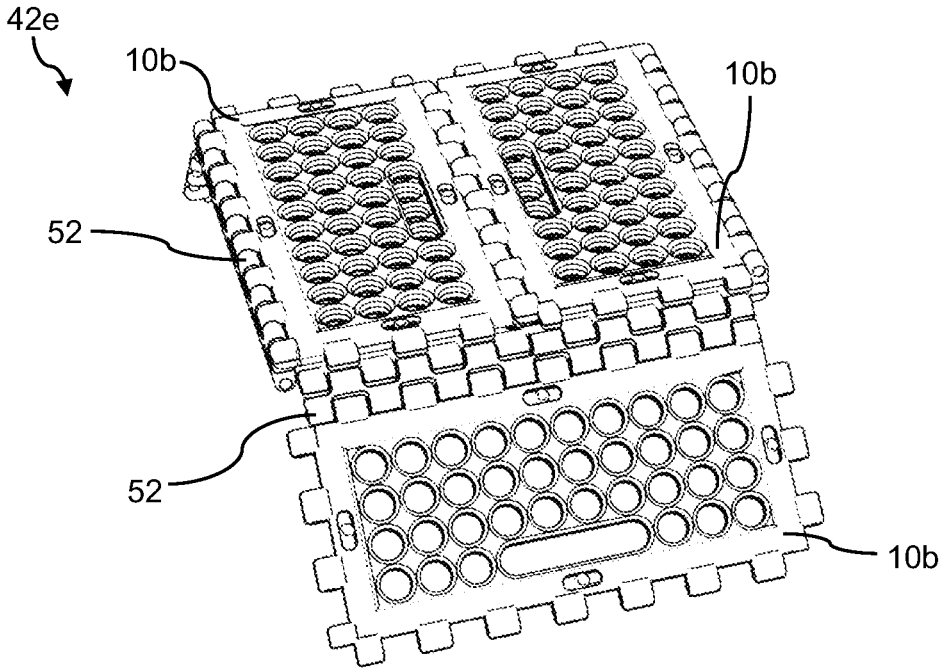
Figure 27F:
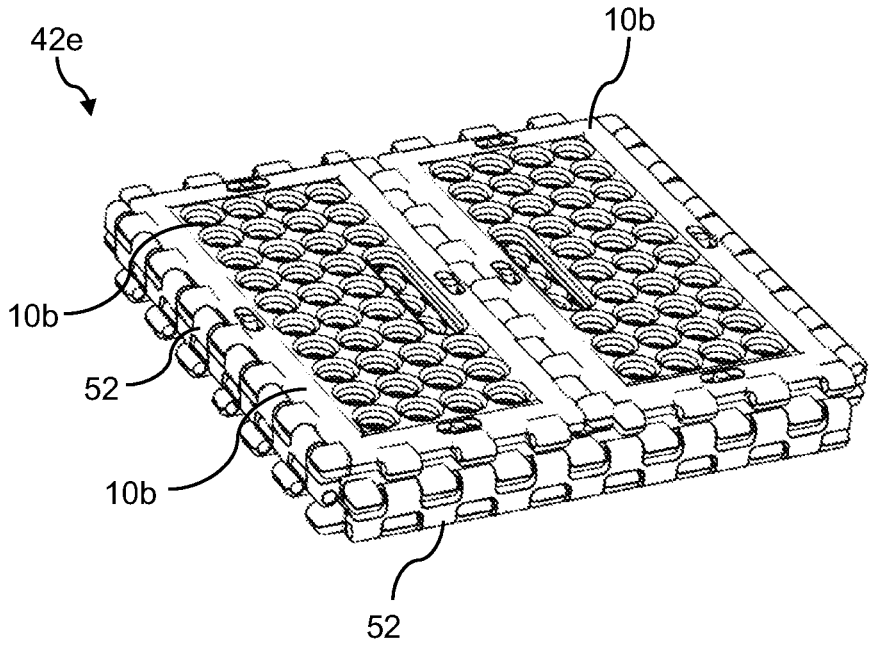

The folding connectors 52, 54 enable the provision of foldable boxes or crates. An example of such an assembly unit 42*e* in the form of a foldable crate is shown in FIG. 27*a*, FIG. 27*b*, FIG. 27*c*, FIG. 27*d*, FIG. 27*e*, and FIG. 27*f*, in which different states of the foldable crate are shown for transferring the crate from an assembled state, as shown in FIG. 27*a*, to a folded state, as shown in FIG. 27*f*. For providing such a crate, the structural components 10*b* forming the side walls of the crate are each connected to the structural component 10*a* forming the bottom of the crate by means of a folding connector 52 arranged between the coupling units 14 of the coupled sides 12.

The modular system comprises further connectors 58 by means of which two structural components may be structurally coupled to one another via their inner portions 16. In this way, boxes formed by the structural components 10*a*-10*e* can be connected to one another, as shown in FIGS. 28 and 29.

Figure 28:
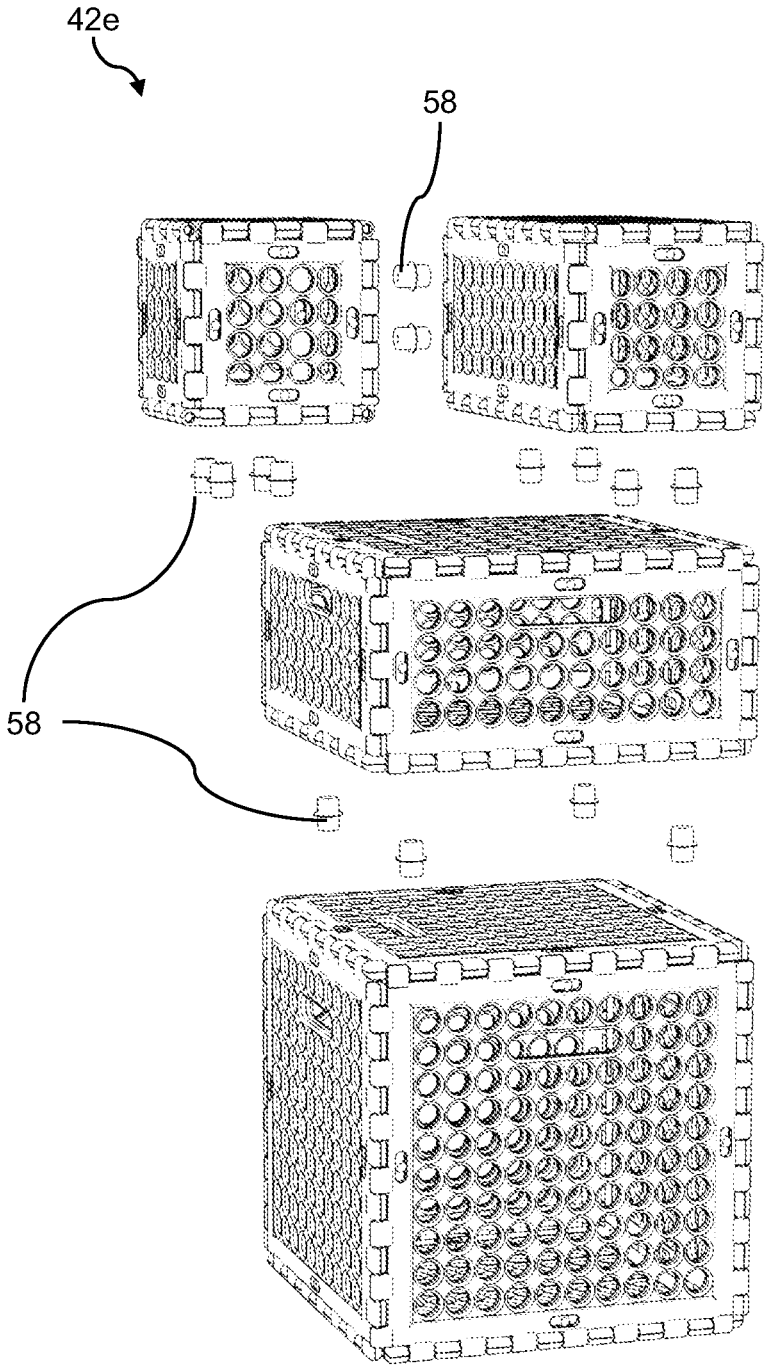
FIG. 28 is an exploded view of a further assembly unit.
Figure 29:
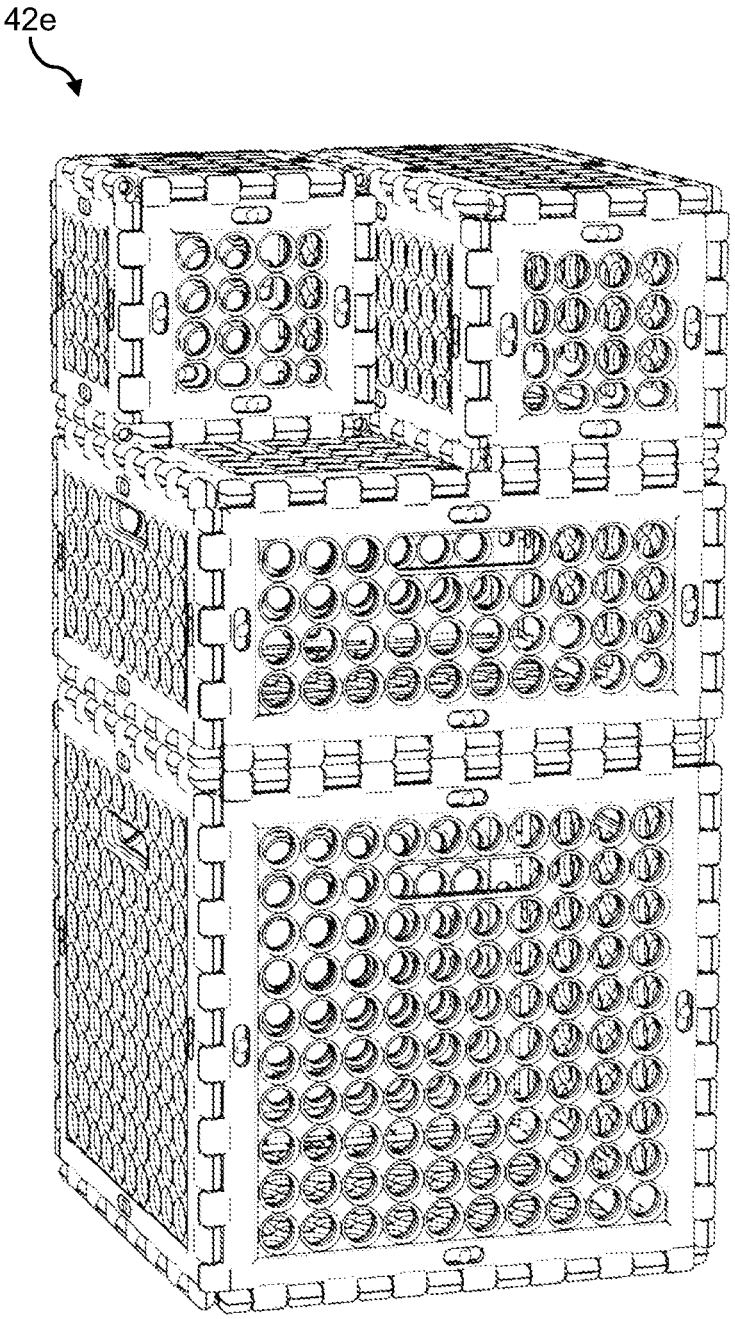
FIG. 29 is a perspective view of the assembly unit shown in FIG. 27.

FIG. 28 shows an exploded view of a further assembly unit 42*e* formed by a plurality of interconnected containers. FIG. 29 shows a perspective view of the same assembly unit 42*e*. In the assembly unit 42*e*, the individual containers are each structurally coupled by four connectors 58 to an underlying container and by two connectors 58 to a laterally adjacent container. The connectors 58 include two hollow cylindrical plugs or connectors projecting on opposite sides from a central disc. The hollow cylindrical plugs are configured to be form-fittingly and/or force-fittingly coupled to recesses of the inner portions 16 of the structural components 10*a*-10*e*.

Figure 30:
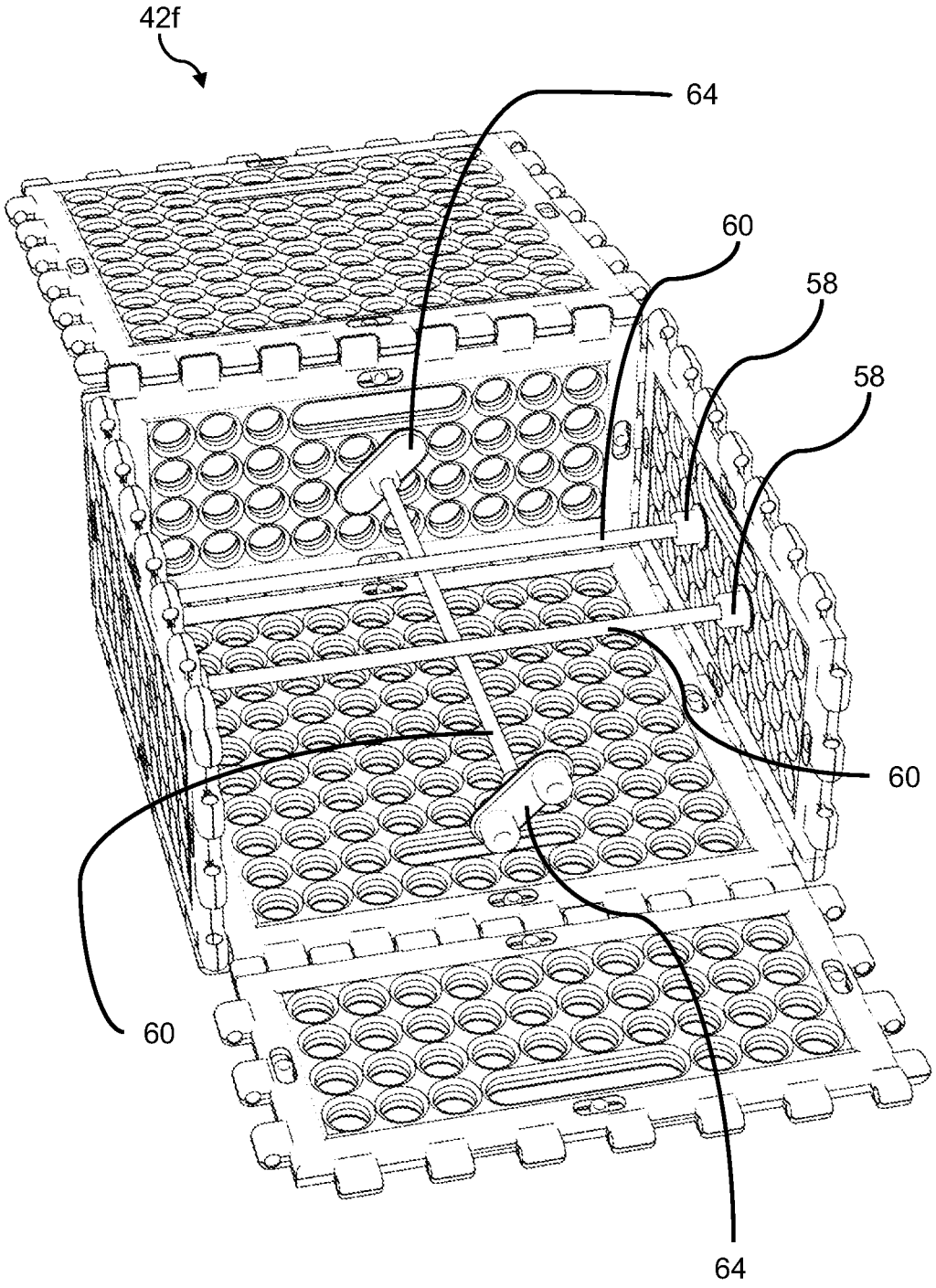
FIG. 30 a perspective view of a further assembly unit.

The modular system further comprises a first and a second strut 60, 62, the second strut 62 being half as long as the first strut 60. The struts 60, 62 are intended to be arranged between and to be connected to two inner portions 16 of opposing structural components 10*a*-10*e*. For doing so, the connectors 58 may be used. Specifically, the ends of the struts 60, 62 can be received in a recess provided in the plugs of the connector 58. In some embodiments, further connectors 64 of the modular system may be used which allow the struts 60, 62 to be fastened centrally between two recesses of the inner portion 16 of the structural component 10*a*-10*e*. The further connectors 64 have an elongated bridge on which a hollow cylindrical plug is arranged centrally on one side and on the opposite side two further hollow cylindrical plugs are arranged in the region of the end portions of the bridge. The struts 60, 62 may be intended to increase the mechanical stability of an assembly unit and/or to subdivide an accommodation space of an assembly unit, as shown in FIG. 30.

FIG. 31, FIG. 32, FIG. 33, FIG. 34, FIG. 35, and FIG. 36 show a further assembly unit 66*a* which, accordingly, is intended for use in storage systems or bundling systems or transport systems or structural installations. FIG. 31, FIG. 32, FIG. 33, FIG. 34, and FIG. 35 depict the assembly unit 66*a* in different states to illustrate the structural configuration of the assembly unit 66*a*.

Figure 31:
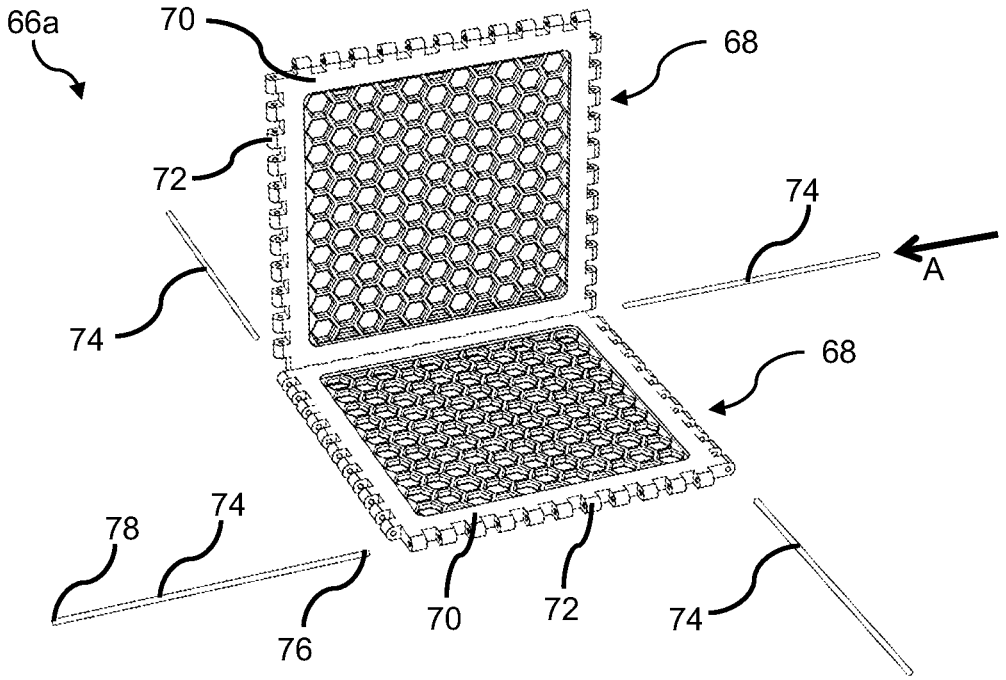
FIG. 31, FIG. 32, FIG. 33, FIG. 34, and FIG. 35 are perspective views of a further assembly unit.

The further assembly unit 66*a* comprises a plurality of plate-shaped or shell-shaped further structural components 68, each having four further sides 70. Each side 70 is provided with correspondingly designed coupling elements 72. The coupling elements 72 of a first further aside 70 of a first further structural component 68 are in engagement with the correspondingly designed coupling elements 72 of a second further side 70 of a second further structural component 68, as shown in FIG. 31. The coupling elements 72 may be designed correspondingly or similar to the second coupling elements 22 of the above-described structural component 10. Compared to the above-described structural component 10, the further structural component 68 is not equipped with first coupling elements 20 and an actuation mechanism 26. Thus, the further structural component 68 is provided without movable components. The coupling elements 72 are integrally provided at the further sides 70.

In some embodiments, the further assembly unit 66*a* comprises coupling rods 74 which are designed correspondingly to the coupling elements 72 and which are configured to form-fittingly connect the coupling elements 72 of two engaged further structural components 68. For doing so, a coupling rod 74 is guided through mutually aligned recesses, specifically cylindrical recesses, in the coupling elements 72, as indicated by an arrow A in FIG. 31. The recesses in the coupling elements 72 have a shape which is correspondingly designed to the shape of the coupling rod 74. The length of the coupling rod 74 corresponds substantially to a width of the further side 70 of the further structural component 68. The coupling rod 74 is made of the same material as the further structural components 68. Two coupled further structural components 68 are pivotable relative to each other by 240° about a pivot axis extending along the longitudinal axis of the coupling rod 74.

Figure 32:
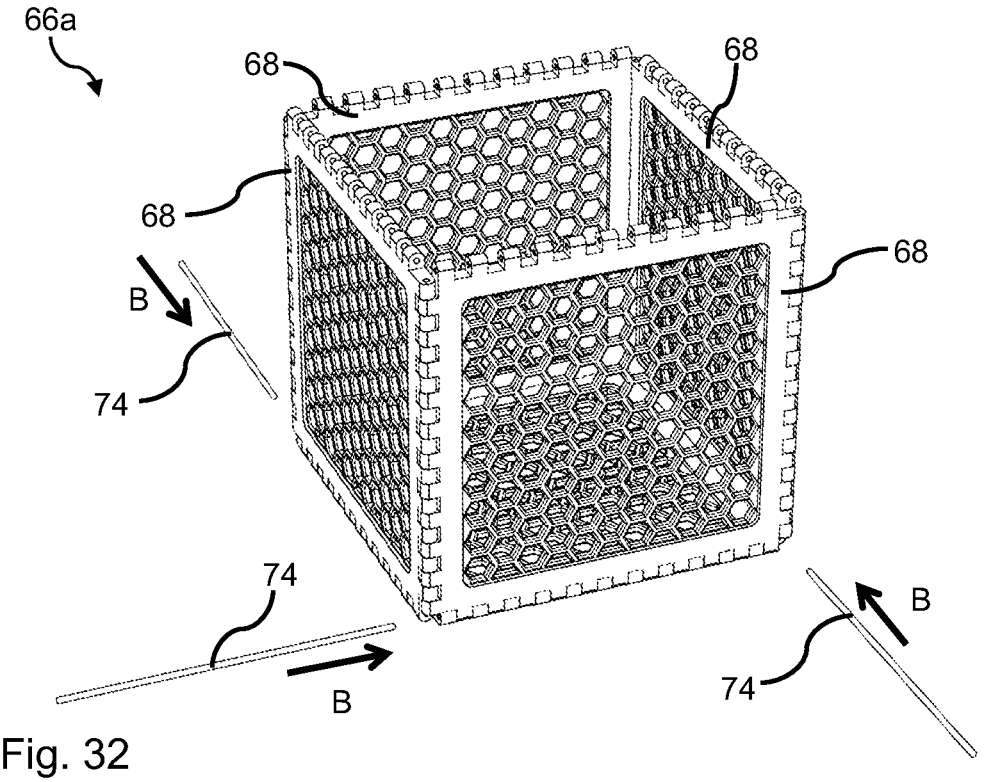
Figure 33:
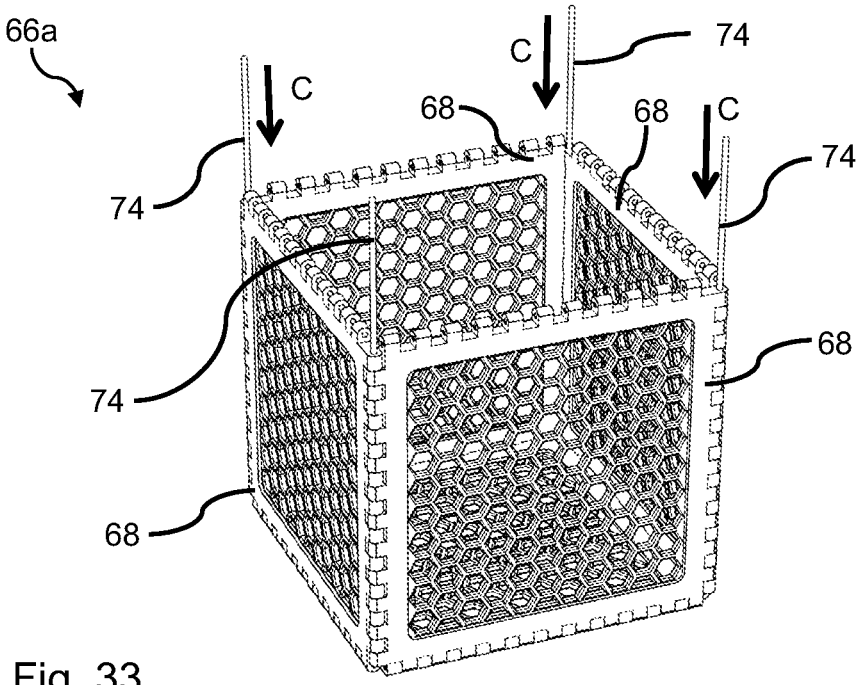

FIG. 32 shows a state in which three further structural components 68 are provided. In this state, the interconnected further structural components 68 form a container. The three further structural components 68 form side walls of the container and are engaged, at their bottom sides 70, with the further structural component 68 forming a bottom. In some embodiments, at their lateral sides 70, the further structural components 68 forming side walls are engaged with those further structural components 68 which form adjacent side walls. In order to form-fittingly connect the three further structural components 68, three further coupling rods 74 are inserted into the engaged coupling elements 72 of the different further structural components 68, as indicated by arrows B in FIG. 32. By doing so, a form-fit connection to the further structural component 68 forming the bottom is achieved. In order to further connect the further structural components 68 forming the side walls in a form-fitting manner, four further coupling rods 74 are inserted into the engaged coupling elements 72, as indicated by arrows C in FIG. 33.

Figure 34:
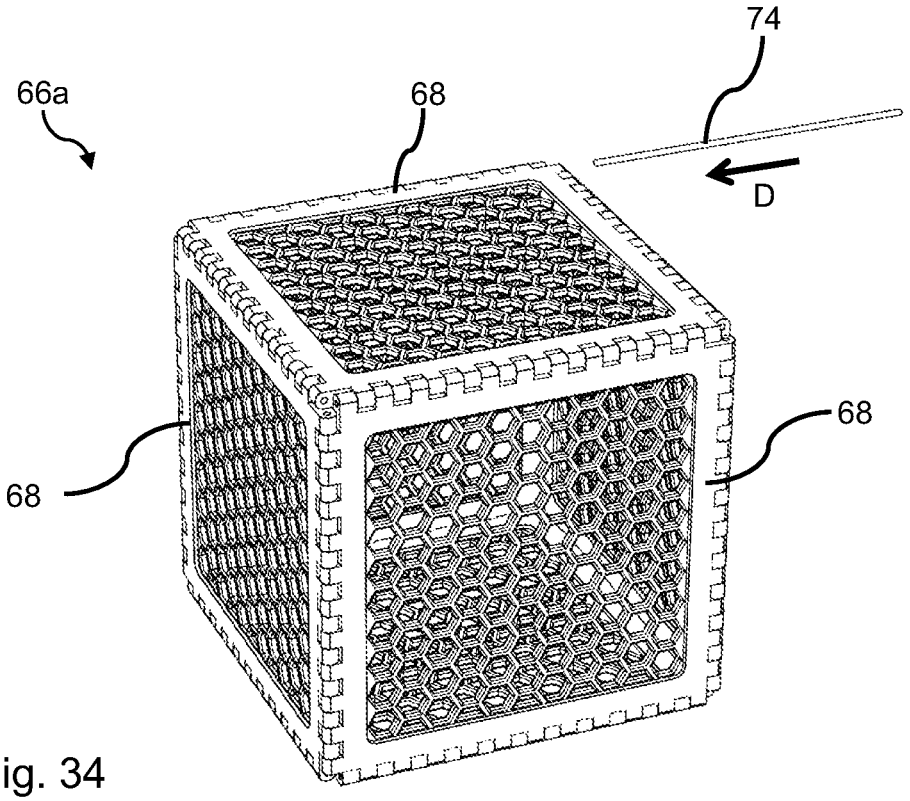
Figure 35:
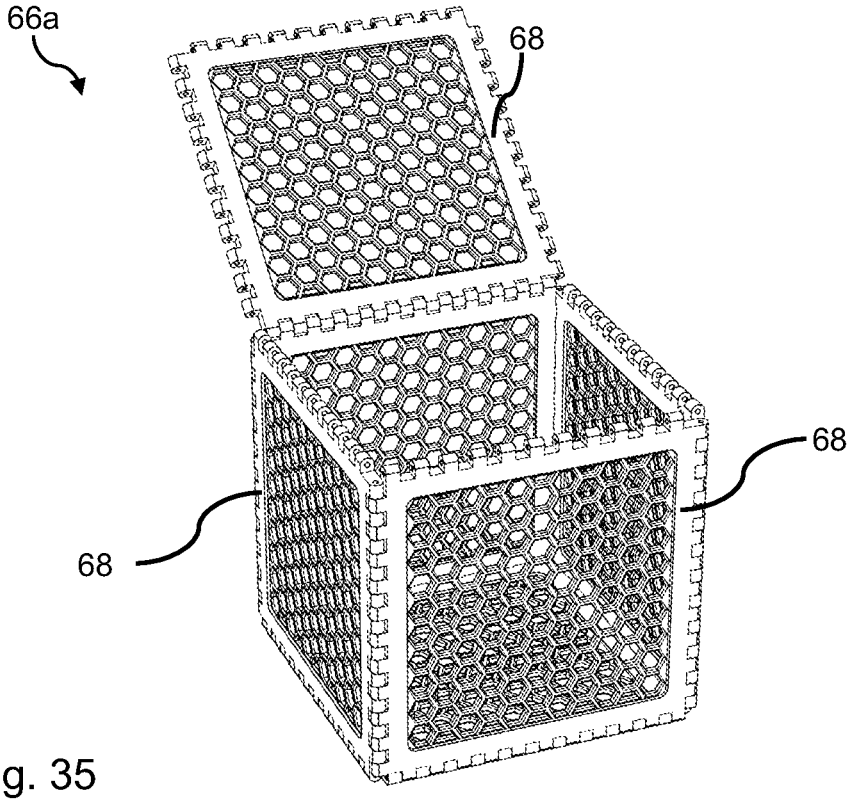

The container is further provided with a lid formed by a further structural component 68, as shown in FIG. 34. The lid is pivotable between a closed position shown in FIG. 34 and an open position shown in FIG. 35. The further structural component 68 forming the lid is form-fittingly connected at one side 70 via its coupling elements 72 to coupling elements 72 of a further structural component 68 forming a side wall by means of a further coupling rod 74 inserted therebetween, as shown by an arrow D in FIG. 34.

Figure 36:
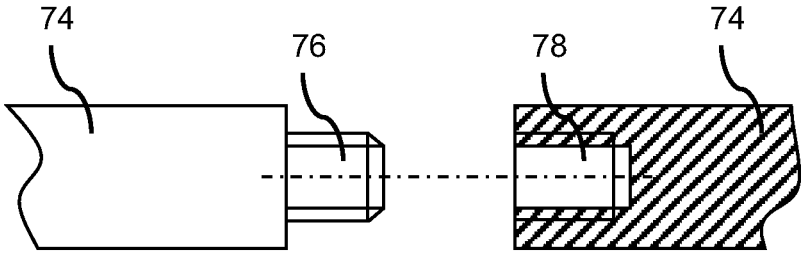
FIG. 36 depicts enlarged views of a coupling rod.

The coupling rod 74 comprises a first coupling element 76 at a first end portion and a correspondingly designed second coupling element 78 at a second end portion opposite to the first end portion, as shown in FIG. 36.

In the shown configuration, the first coupling element 76 is provided in the form of a threaded rod and the second coupling element 78 is provided in the form of a threaded bore corresponding thereto. By this configuration, a plurality of coupling rods 74 can be screwed together. In the area of the first and the second connecting element 76, 78, the coupling rod 74 may have a cross-sectional profile with a non-circular outer contour. For example, the outer contour of the cross-sectional profile may be provided in the form of a polygon, such as a quadrangle or hexagon.

Figure 37:
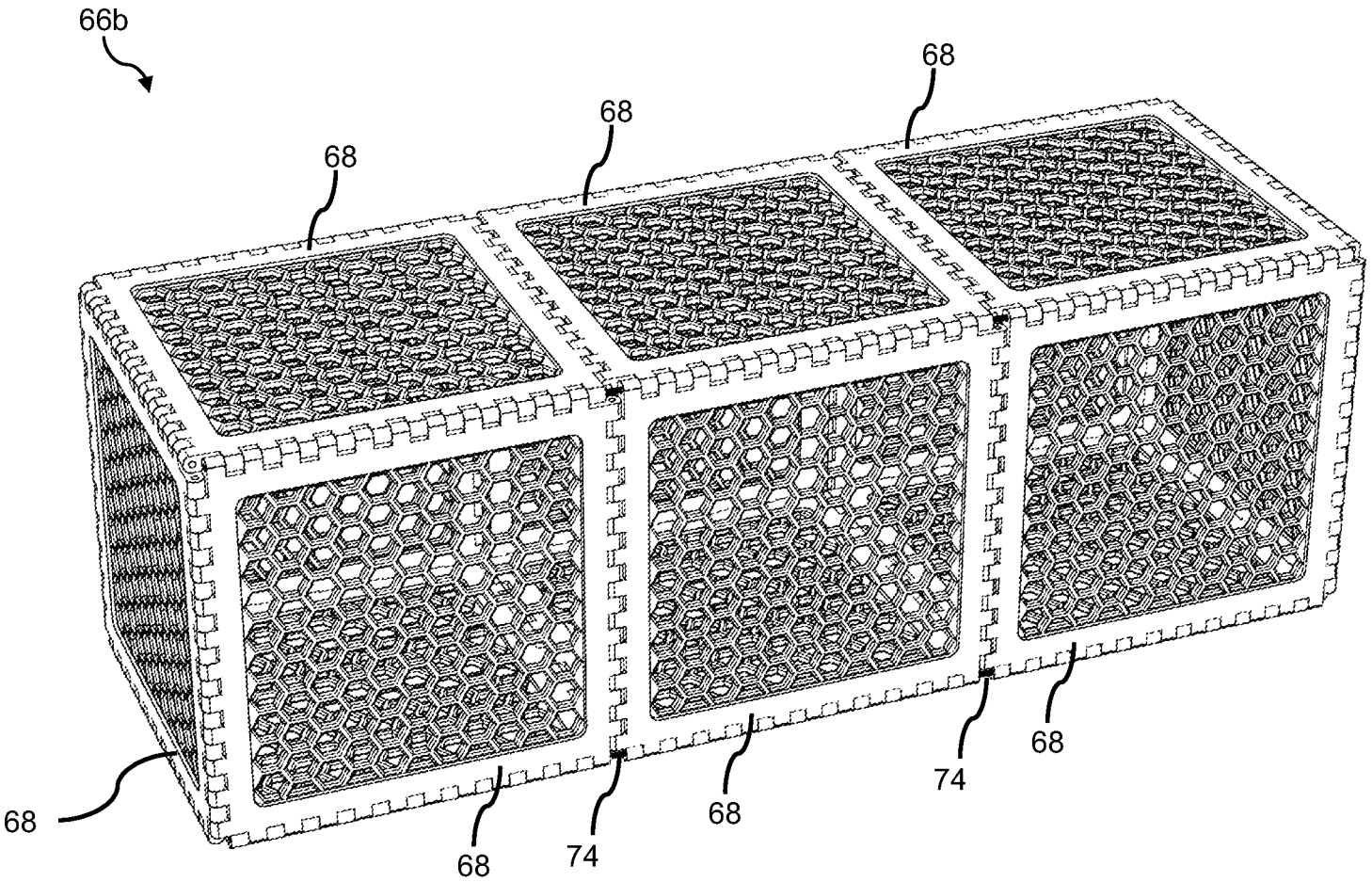
FIG. 37 is a perspective view of a further assembly unit.

The first and the second coupling element 76, 78 of the coupling rod 74 enable that a plurality of further structural components 68 arranged in a plane can be coupled together and released from each other with reduced effort, as shown in FIG. 37. In the further assembly unit 66*b* shown in FIG. 37, a bottom, two side walls and a lid are each formed by three further structural components 68 coupled in a plane. Here, the bottom, the two side walls and the lid are form-fittingly connected by means of three coupling rods 74 connected via their coupling elements 76, 78.

It will be obvious for a person skilled in the art that these embodiments and items only depict examples of a plurality of possibilities. Hence, the embodiments shown here should not be understood to form a limitation of these features and configurations. Any possible combination and configuration of the described features can be chosen according to the scope of the disclosure.

The invention claimed is:

1. A structural component, wherein:

the structural component is plate-shaped or shell-shaped and comprises at least three sides, wherein at least two sides are provided with a coupling unit for structurally connecting the structural component to a further component, wherein the coupling unit comprises at least one first locking element and at least one correspondingly designed second locking element; and for connecting the structural component to the further component, the first locking element and the second locking element are displaceable relative to one another from a release position into a first locking position upon moving the first locking element or the second locking element in a first locking direction and are displaceable relative to one another from the release position into a second locking position upon moving the first locking element or the second locking element in a second locking direction different from the first locking direction, wherein:

in the release position, the structural component and the further component can be translated with respect to one another such that the structural component and the further component can be engaged or disengaged with one another;

in the first locking position, the structural component and the further component cannot be translated with respect to one another such that the structural component and the further component cannot be disengaged from one another;

in the second locking position, the structural component and the further component cannot be translated with respect to one another such that the structural component and the further component cannot be disengaged from one another; and the second locking position is different from the first locking position.

2. The structural component according to claim 1, wherein the structural component comprises four sides, each of which comprises one coupling unit, and wherein the structural component has a width or a length in a range of 10 cm to 40 cm.

3. The structural component according to claim 1, wherein the first locking element or the second locking element is integrally formed at the sides.

4. The structural component according to claim 3, wherein the first locking element or the second locking element is arranged point-symmetrically or mirror-symmetrically.

5. The structural component according to claim 1, wherein the coupling unit is configured to provide a rotatory degree of freedom around a pivot axis being parallel to a width direction of the coupling unit in a coupled state in which the coupling unit is engaged with a structurally identical further coupling unit of the further component.

6. The structural component according to claim 5, wherein in the coupled state, the structural component and the further component are pivotable relative to one another about the pivot axis by at least 210°.

7. The structural component according to claim 1, wherein each one of the first locking position and the second locking position constitutes an end position.

8. The structural component according to claim 1, wherein the coupling unit is designed to be connectable to a structurally identical coupling unit of the further component in a form-fitting manner, wherein in a coupled state in which the coupling unit is engaged with the further coupling unit, displacing the first and the second locking element relative to one another causes displacement of further locking elements of the further coupling unit relative to one another.

9. The structural component according to claim 1, wherein the second locking element adjoins a first receiving space at a first side and a second receiving space of the coupling unit at an opposite side, wherein the first locking element at least partially protrudes into the first receiving space in the first locking position and at least partially protrudes into the second receiving space in the second locking position, and wherein the first locking element is arranged adjacent to or spaced apart from the first and the second receiving space in the release position.

10. The structural component according to claim 1, wherein the coupling unit comprises an actuation mechanism configured to transfer an actuation of a control element into an actuation of the at least one first locking element or the at least one second locking element of the coupling unit.

11. The structural component according to claim 10, wherein the actuation mechanism comprises a resistance unit configured to set a minimal actuation force of the actuation element in dependence on a relative position between the first and the second locking element.

12. The structural component according to claim 11, wherein the resistance unit is configured such that, in a state in which the first and the second locking element are arranged relative to one another in at least one of the first locking position, the second locking position, or the release position, the minimal actuation force of the control element is greater compared to a state in which the first and the second locking element are arranged relative to one another in at least one of a position between the first locking position and the release position or a position between the second locking position and the release position.

13. The structural component according to claim 1, wherein the sides and the first and the second locking element of the structural component are made of a same material.

14. The structural component according to claim 13, wherein the sides and the first and the second locking element of the structural component are made of plastic.

15. An assembly unit, comprising at least two interconnected structural components according to 1.

16. The assembly unit according to claim 15, comprising at least five structurally coupled structural components which constitute a container.

17. A structural component, comprising:

a plate-shaped body having a side; and a coupling unit positioned on the side, wherein the coupling unit comprises:

an actuation mechanism, the actuation mechanism comprising a bar movably mounted along a width direction of the coupling unit;

a first locking element having a longitudinal axis parallel to the width direction of the coupling unit, wherein the first locking element is fixedly connected to the bar; and a second locking element comprising a receiving seat along the width direction of the coupling unit for receiving the first locking element, wherein:

along the width direction of the coupling unit, the second locking element is arranged adjacent to a first receiving space on one side of the second locking element and adjacent to a second receiving space on an opposite side of the second locking element;

the second locking element is integrally formed at the side; and the actuation mechanism is configured to translate the first locking element along the width direction of the coupling unit such that the first locking element is displaceable relative the second locking element.

* * * * *